US005727883A

United States Patent [19]

Kusano et al.

[11] Patent Number: 5,727,883

[45] Date of Patent: Mar. 17, 1998

[54] WINDING MEMBER FOR WINDING AN INK SHEET, HOUSING MEMBER FOR HOUSING SUCH A WINDING MEMBER, AND RECORDING APPARATUS FOR RECORDING ON A RECORDING MEDIUM BY USE OF SUCH A HOUSING MEMBER

[75] Inventors: Yutaka Kusano, Yokohama; Tatsuya Fukushima, Kawasaki, both of Japan

[73] Assignee: Canon Kabushiki Kaisha, Tokyo, Japan

[21] Appl. No.: 622,155

[22] Filed: Mar. 27, 1996

Related U.S. Application Data

[63] Continuation of Ser. No. 111,960, Aug. 26, 1993, abandoned.

[30] Foreign Application Priority Data

| | | | |
|---|---|---|---|
| Aug. 31, 1992 | [JP] | Japan | 4-253646 |
| Aug. 31, 1992 | [JP] | Japan | 4-253647 |
| Aug. 31, 1992 | [JP] | Japan | 4-253648 |

[51] Int. Cl.[6] ..... B41J 35/28

[52] U.S. Cl. ..... 400/208; 400/242; 400/246; 400/236; 242/596.7

[58] Field of Search ..... 400/208, 208.1, 400/235, 235.1, 239, 242, 246, 250, 613, 613.1, 614, 236, 236.1, 236.2; 242/532, 532.1, 532.3, 532.4, 541, 541.2, 541.5, 596, 596.5, 596.7, 596.8

[56] References Cited

U.S. PATENT DOCUMENTS

| | | | |
|---|---|---|---|
| 1,088,039 | 2/1914 | Salmon, Jr. | 242/596.7 |
| 1,098,863 | 6/1914 | Wheeler | 242/596.7 |
| 3,623,586 | 11/1971 | Shellabarger | 400/238 |
| 3,809,218 | 5/1974 | Furst | 400/238 |
| 4,265,553 | 5/1981 | Hatsell | 400/238 |
| 4,285,480 | 8/1981 | Parker | 242/532 |
| 4,475,830 | 10/1984 | Schaefer | 400/238 |
| 4,768,039 | 8/1988 | Akutagawa et al. | 400/208 |
| 4,859,097 | 8/1989 | Frerichs | 400/208 |
| 4,924,242 | 5/1990 | Fukawa | 400/208 |
| 5,100,250 | 3/1992 | Suzuki et al. | 400/208 |
| 5,269,612 | 12/1993 | Shimoha et al. | 400/238 |

FOREIGN PATENT DOCUMENTS

| | | | |
|---|---|---|---|
| 0294792 | 12/1988 | European Pat. Off. . | |
| 0403775 | 12/1990 | European Pat. Off. . | |
| 0410396 | 1/1991 | European Pat. Off. . | |
| 0488291 | 6/1992 | European Pat. Off. . | |
| 0522903 | 1/1993 | European Pat. Off. . | |
| 25 23 808 | 12/1976 | Germany | 400/238 |
| 59-196283 | 11/1984 | Japan | 400/238 |
| 61-066675 | 4/1986 | Japan | 400/238 |
| 3-120984 | 10/1991 | Japan | 400/238 |

OTHER PUBLICATIONS

W.C. Trayner, "Polyethylene Terephthalate Trailer Assembly for Correctable Ribbons", IBM TDB, vol. 23, No. 10, 4552, Mar. 1981.

*Primary Examiner*—David A. Wiecking
*Attorney, Agent, or Firm*—Fitzpatrick, Cella, Harper & Scinto

[57] ABSTRACT

A recording apparatus includes conveying means for conveying a recording medium, a platen for conveying and supporting the recording medium and an ink sheet, recording means for pressing the recording medium and ink sheet to the platen and heating the ink sheet to record images the recording medium. This ink sheet has a first guiding member and a second guiding member which are bonded, respectively, to both ends of the ink sheet. The first and second guiding member bonded to both ends of the ink sheet substitute for a winding reel and supply reel. Therefore, these reels are no longer needed to make it possible to reduce the parts numbers, and implement the use of inexpensive materials.

11 Claims, 31 Drawing Sheets

WINDING MEMBER FOR WINDING AN INK SHEET, HOUSING MEMBER FOR HOUSING SUCH A WINDING MEMBER, AND RECORDING APPARATUS FOR RECORDING ON A RECORDING MEDIUM BY USE OF SUCH A HOUSING MEMBER

This application is a continuation of Application Ser. No. 08/111,960, filed Aug. 26, 1993, now abandoned.

BACKGROUND OF THE INVENTION

1. Field of the Invention

The present invention relates to an ink sheet, a winding member for winding such an ink sheet, a housing member for housing such a winding member, and a recording apparatus for recording on a recording medium by use of such a housing member.

2. Related Background Art

An ink sheet for a thermal transfer recording apparatus which uses it has hitherto constituted an integral ink cassette in such a manner that one end of the ink sheet 101 is fixed to a supply reel 102 for winding, while an other end of the ink sheet 101 is fixed to a winding reel 103 to wind it around the reel as shown in FIG. 29, and that springs 104 are inserted into the reel pivots 105 of the supply reel 102 and the winding reel 103, respectively, and are incorporated in the lower cassette 106, then welding the upper cassette 107 to the lower cassette 106 for integration.

Each time the transfer recording is made, the ink sheet 101 is wound by the winding reel 103 in the cassettes 106 and 107. When a predetermined number of the sheets for transfer recording is brought to a termination, an operator removes the cassette from the thermal transfer recording apparatus by a given method. The removed cassette is in a state where the used ink sheet 101 has completely been wound up by the winding reel 103 and there is no ink sheet 101 left on the supply reel 102 side. These used cassettes are disposed of as industrial waste together with the used ink sheets 101, winding reels 103, and supply reels 102.

As described above, the cassette used for the conventional apparatus is the so-called "disposable" cassette, which is discarded as a whole as industrial waste when a given number of the recording sheets is brought to a termination. Whereas the main cassettes and winding and supply reels are the parts used only for a short period of time (life), these are manufactured with the same precision and materials as those of the parts used for the main body of the recording apparatus. Therefore, the cassette tends to be of an excessive quality, leading to an increased unit price thereof. Hence, there is a disadvantage that the operating cost of the entire system using such cassette becomes high.

Also, the entire parts of the cassette are disposed of together as industrial waste, while its recycling utilization method is yet to be established. Therefore, it is regarded as a device which lacks the consideration toward the environmental protection which is required by the public in the recent years.

Also, to cope with the recent ecological boom, there has been proposed an ink cassette in which its supply and winding reels are removable, as shown in FIGS. 30A and 30B. A cassette of the kind is of such a structure that the pivots 102*a* and 103*a* of the supply reel 102 and winding reel 103 are inserted into the bearings 108*a* of the cassette 108, respectively, and then the spring units 108*b* are deformed at the ends of the pivots 102*a* and 103*a* so that the connecting parts 102*b* and 103*b* are inserted into the reel holding parts 108*c*, respectively. After use, each of the reels 102*b* and 103*b* can be removed from the cassette 108. Thus, the reuse of the ink cassette itself is implemented.

However, the aforesaid integral ink cassette should be discarded including the cassette itself after use due to its structure. Also, regarding the cassette having the removable supply and winding reels, the replacement of the ink sheets needs complicated procedures. In addition, an operator himself must replace the ink sheets. Therefore, should he drop it during the replacement, trouble may easily take place that the ink sheet becomes loose. Moreover, if the mounting positions are not exact, the ink sheet tends to be twisted or crinkled so that the printing quality may be lowered conspicuously. Also, even if the cassette is reusable, the emptied supply reel and the winding reel with the used ink sheet wound around it must be disposed of as waste.

Since the used ink sheet is tightly wound around the winding reel, the used ink sheet and the winding reel cannot be separated easily. It is, therefore, difficult to implement the collection of the used ink sheet and the molded ink reel separately for recycling.

Also, there is proposed a thermal transfer recording apparatus which does not use any ink cassette by bonding a lead film 109 to the end of an ink sheet 101 wound around a supply reel 102 as shown in FIG. 31A to allow the ink sheet 101 to be fed automatically by utilizing the aforesaid lead film 109.

However, when using the above-mentioned lead film 109 for the automatic loading of the ink sheet 101, the lead film 109 is wound around over the ink sheet 101 which has been wound around the supply reel 102 as shown in FIG. 31B. Usually, a film material contains a plasticizer, and if the lead film 109 containing a plasticizer is directly in contact with the ink sheet 101, the plasticizer contained in the lead film 109 is transferred to the ink sheet 101 to change the value of the physical properties of its ink. As a result, there is a possibility that the image quality is lowered after printing.

Also, in order to prevent the lead film 109 wound around the ink sheet 101 from getting loose, the end of the lead film 109 is fastened by a tape 110 or the like. The user must remove the tape 110 each time the ink sheet 101 is replaced. If the user should inadvertently drop the ink sheet while removing the tape, it may easily become loose.

SUMMARY OF THE INVENTION

It is an object of the present invention to solve the problems encountered by the prior art as described above, and provide an ink sheet for which the implementation of a resource saving is possible while providing its easier handling when starting to use it, and a winding member for winding such an ink sheet.

It is another object of the present invention to provide an ink sheet which does not need any winding reel that is required for winding a used ink sheet, and a recording apparatus using such an ink sheet.

It is still another object of the present invention to provide an ink sheet housing member which requires no supply and winding reels so that the cassette containing an ink sheet can be used repeatedly and, at the same time, enables the ink sheet housing member to be recycled, while making the unit price of the housing member inexpensive to reduce the cost of the entire recording apparatus, as well as taking the environmental protection into account, and a recording apparatus using such a housing member.

It is a further object of the present invention to provide an ink sheet for which a guiding member is bonded to the free end of the ink sheet wound around a winding member.

It is still a further object of the present invention to provide an ink sheet for which a guiding member is bonded to the free end of the ink sheet used for a recording apparatus provided with a recording medium, and the recording means which presses a platen through the ink sheet in order to record images on the recording medium by giving energy from the recording means to the ink sheet.

It is another object of the present invention to provide an ink sheet capable of being mounted for recording by bonding a guiding member to the free end of the ink sheet wound around a winding member in order to lead out the guiding member from the winding member which is installed in the apparatus main body for leading out the ink sheet in the longitudinal direction, and the winding member for winding such an ink sheet.

It is still another object of the present invention to provide an ink sheet having a first and second guiding members which are bonded respectively to both ends thereof, while having the ink sheet, a platen which holds and feeds a recording medium, and recording means which records images on the recording medium by pressing the ink sheet and recording medium on the platen in order to heat the ink sheet.

It is still another object of the present invention to provide an ink sheet having a first guiding member bonded to its free end and a second guiding member bonded to the end of its winding side, the ink sheet being fed by leading out the first guiding member of the ink sheet which is wound around the second guiding member functioning as the supply reel, and sequentially wound up as the used ink sheet by winding it around the first guiding member which functions as the winding reel, as well as a winding member which winds such an ink sheet, a housing member for housing such a winding member, and a recording apparatus using such a housing member.

It is still another object of the present invention to provide an ink sheet which is replaceable by removing the used recording medium from an ink sheet housing member where it remains as being wound around a first guiding member when a second guiding member has been wound up by the first guiding member which functions as the winding reel, as well as a winding member which winds such an ink sheet, the housing member for housing such a winding member, and a recording apparatus using such a housing member.

It is a further object of the present invention to provide a recording apparatus comprising conveying means for conveying a recording medium; a platen to feed and hold the recording medium; and recording means for recording images on the recording medium by pressing the recording medium and ink sheet to the platen to heat the ink sheet, wherein a first and second Guiding members are bonded to both ends of the ink sheet, respectively.

DETAILED DESCRIPTION OF THE PREFERRED EMBODIMENTS

(First Embodiment)

FIG. 1A to FIG. 10B are views illustrating each of the ink sheet cassette A, supply reel driving device, winding reel driving device, lead driving device, and recording apparatus B embodying the present invention or to which the present invention is applicable, as well as the relationship between each of them. Hereinafter, in conjunction with these drawings, the structure of each part will be described.

(1) Description of the Structure of a Recording Apparatus B

Figure 4A:
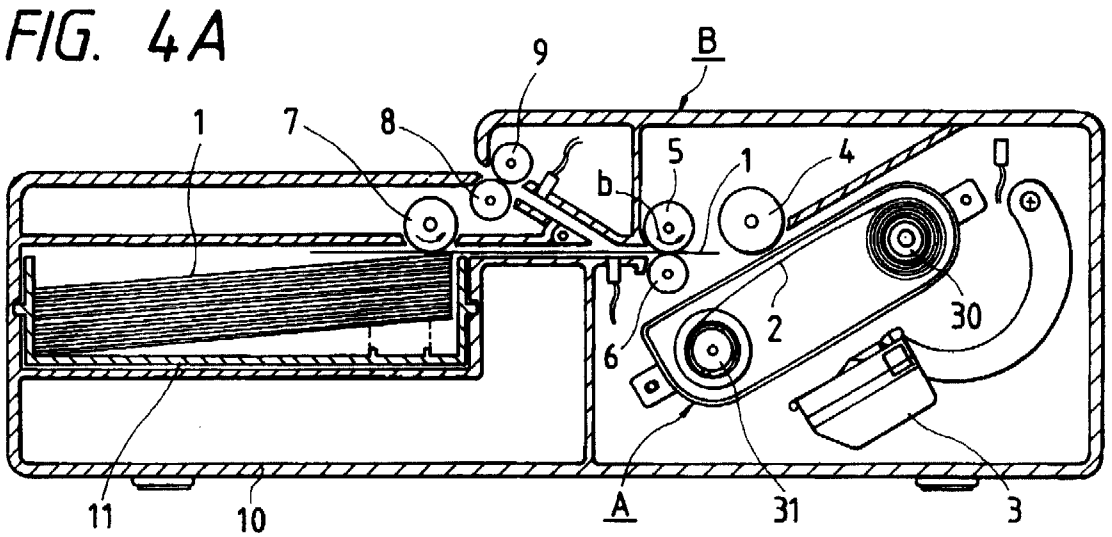
FIGS. 4A and 4B are views illustrating the structure of a recording apparatus.
Figure 4B:
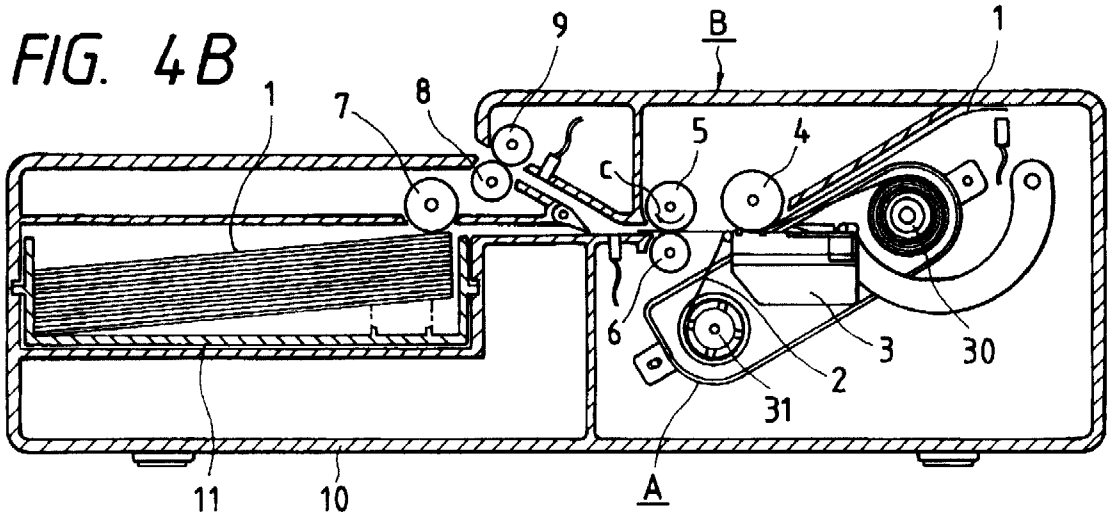

FIGS. 4A and 4B are cross-sectional views showing a recording apparatus B which performs recording by installing in it an ink cassette A which will be described later. The recording apparatus B records images on a recording sheet 1 serving as a recording medium in accordance with the image signals which are transmitted from another apparatus.

In FIG. 4A, the recording sheets 1 serving as a recording medium are stacked for storage in a sheet cassette 11, and are fed one by one from the top by driving a feed roller 7 rotatively in the direction indicated by an arrow a. The recording sheet 1 thus fed is pinched under pressure by a driving roller 5 which is driven to rotate in the direction indicated by an arrow b and a pressure roller 6 so that the sheet is further conveyed to a position where the recording is started in a first color.

In FIG. 4B, the arrangement is made so that the above-mentioned recording sheet 1 and an ink sheet 2 are pressed by a recording head 3 serving as recording means onto a platen roller 4 side to allow them to be superposed; the recording sheet 1 and the ink sheet 2 are conveyed by driving the driving roller 5 serving as feeding means rotatively in the direction indicated by an arrow c; thus, in synchronism with the conveyance of the recording sheet 1 and the ink sheet 2, the recording head 3 is caused to generate heat in accordance with the image signals to fuse (including sublimation, hereinafter the same) the ink which is coated on the ink sheet 2; and the fused ink is transferred to the recording sheet 1 to form images thereon.

With the above, the recording is completed for one image portion in one color. It is then arranged that when three image portions in three colors are completed likewise, the recording sheet 1 is conveyed by a pair of delivering rollers 8 and 9 to let it out from the apparatus.

Figure 2A:
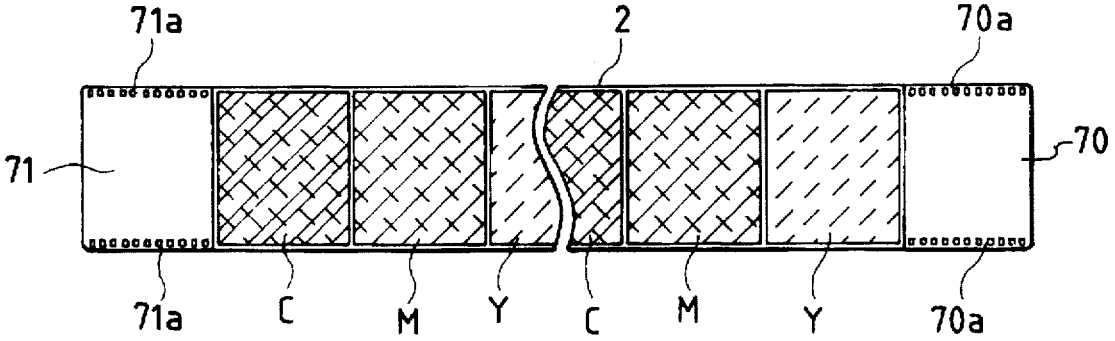
FIGS. 2A and 2B are a plan view and a perspective view showing an ink sheet and its lead.
Figure 2B:
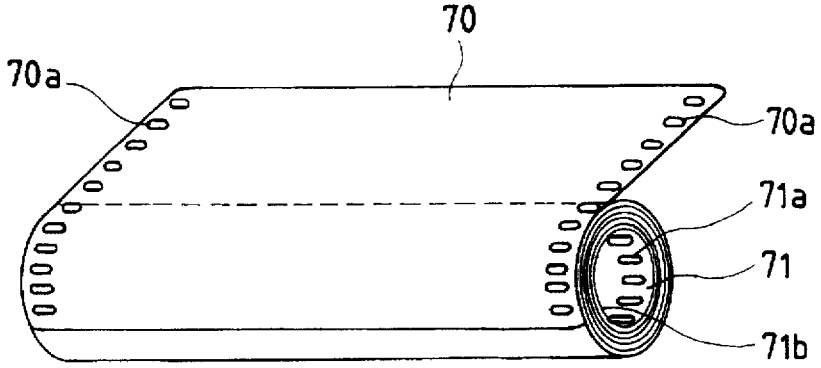

Also, the ink sheet 2 in the present embodiment is an elongated transfer sheet as shown in FIG. 2A on which coloring matters, Y (yellow), M (magenta), and C (cyanogen), are coated in each of the separated sections in that order. To both ends thereof, a lead 70 which is a first guiding member and a lead 71, a second guiding member, are mounted, respectively. In the present embodiment, the ink sheet is installed in an ink sheet cassette A constituted as described later. Also, its mode before the installation in the ink sheet cassette A is such that the leads 70 and 71 are respectively wound around the outermost circumference and the innermost circumference of the ink sheet 2 in order to implement the protection of the ink sheet, the improvement of its handling, and its holding as shown in FIG. 2B.

In this respect, the lead 71 wound around the innermost circumference and the lead 70 wound around the outermost circumference are both configured in the same shape to suppress any increase in its manufacturing cost, but it may be possible to arrange the lead 71 wound around the innermost circumference to be configured without any lead holes 71*a*.

It is then structured that the ink sheet cassette A is detachably installed in the apparatus main body 10.

(2) Description of the Structure of the Cassette A

Figure 1A:
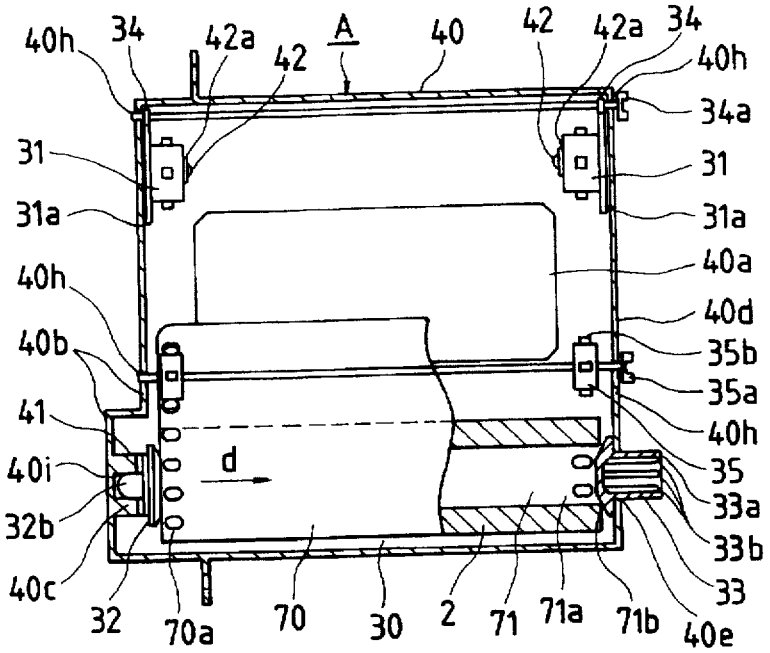
FIGS. 1A to 1D are a cross-sectional view showing an ink sheet cassette used for a recording apparatus, and views illustrating its parts installed in its inside.
Figure 1B:
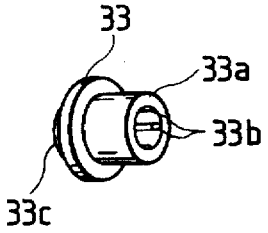
Figure 1C:
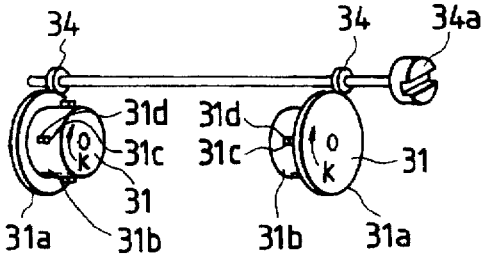
Figure 1D:
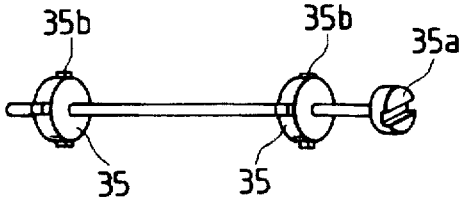

FIG. 1A is a cross-sectional view showing an ink sheet cassette A in which an elongated ink sheet 2 wound around a lead 71 (hereinafter referred to as a supply reel 30) is installed. FIG. 1B is a perspective view showing the one end of the supply reel shown in FIG. 1A which engages with a supply reel driving device to be described later. FIG. 1C is a perspective view showing the both ends of the winding reel shown in FIG. 1A which engage with a winding reel driving device to be described later for winding up the lead and ink sheet. FIG. 1D is a perspective view showing a sprocket which engages with the lead driving device to be described later for feeding the lead to the winding unit of the winding reel.

In FIG. 1A, the elongated ink sheet 2 is wound around the lead 71 while a lead 70 is bonded to its free end. This lead 70 is wound around the winding reel 31 (on both sides) by the winding reel driving device which will be described later, thus winding up the ink sheet 2 subsequent to recording.

The above-mentioned supply 30 is installed in a case 40. The winding reel 31 is rotatively supported by shafts 42 provided in the case 40. The one end of the supply reel 30 in the longitudinal direction (on the left-hand side in FIG. 1A) fits into a pivot 32 mounted on a side wall 40*b* while the other end (on the right-hand side in FIG. 1A) fits into a holder 33 shown in FIG. 1B. In this way, the supply reel is installed in the case 40. Then, coupling nails 33*b* are formed on the inner circumference of the foregoing holder The coupling nails 33*b* are arranged to engage with the supply reel driving device which will be described later.

On the outer circumference of the foregoing winding reel 31, a gear 31*a* is formed as shown in FIG. 1C. The pinion gear 34 which engages with the gear 31*a* is fixed to a shaft having a coupling nail 34*a* which is formed at one end (on the right-hand side in FIG. 1C) of the shaft. This coupling nail 34*a* is arranged to engage with the winding reel driving device which will be described later so that the pinion gear 34 is driven. Also, a plurality of winding nails 31*c* are arranged for the cylindrical part 31*b* of the winding reel 31 to wind up the lead 70. In order to wind up the lead 70 assuredly, there are provided for the winding nails 31*c*, the hook type extrusions 31*d* in the same direction as the rotational direction k of the winding reel 31. These extrusions engage with the holes 70*a* of the lead. In this respect, each of the winding nails 31*c* is arranged at the same phase to the winding reels 31 on both sides.

The sprockets 35 are the guide member conveying means which feeds the above-mentioned lead 70, and fixed to the shaft at one end of which the coupling nail 35*a* is formed as shown in FIG. 1D. This coupling nail 35*a* engages with the lead driving device which will be described later to drive the sprockets 35. On the outer circumference of each sprocket 35, the feeding teeth 35*b* are provided to convey the lead 70 to the winding nails 31*c* on the cylindrical parts 31*b* which are the winding parts of the winding reels 31. In this respect, each of the feeding teeth 35*b* is provided at the same phase to the sprockets 35 on both sides.

The case 40 which installs the foregoing supply reel 30 therein has a recording window 40*a* in its central part where the ink sheet 2 is exposed as shown in FIG. 1A. On the side wall 40*b* on one side (left-hand side in FIG. 1A), an extrusion 40*c* is formed. The leading end of the pivot 32 fits in a recess 40*i* provided for the extrusion 40*c*, and at the same time, it is coupled to the spring 41 mounted on the circumference of the extrusion 40*c*. This pivot 32 is supported by the spring 41 rockingly, and allowed to fit in the inner diameter of the end portion 71*b* of the lead 71 of the supply reel 30. Also, on the side wall 40*d* on the other side (right-hand side in FIG. 1A), the holder 33 which fits in the supply reel 30 is rotatively supported in the holder 40*e*.

Also, on the side walls 40*b* and 40*d*, the shafts 42 are provided to support the winding reels 31 rotatively. On the shafts 42, fixing members 42*a* are fixed to prevent the winding reels 31 from falling off in the longitudinal direction of the shafts. Also, on the side walls 40*b* and 40*d*, the holes 40*h* are formed, respectively, to receive the shafts of the pinion gear 34 and that of the sprocket 35. Then, on the inner plane of the foregoing side wall 40*b*, the foregoing spring 41 is mounted. By this spring 41, the supply reel 30 is biased in the direction indicated by an arrow d in FIG. 1A. By this bias, the end of the holder 33 which fits in the supply reel 30 is caused to abut on the inner plane of the side wall 40*d* on the other side of the case 40. Thus, by the friction between them, the rotation of the supply reel 30 is regulated. Therefore, when the ink cassette A is removed from the recording apparatus B, the supply reel 30 does not rotate idle. Hence, the ink sheet 2 will not become loose.

(3) Description of the Supply Reel Driving Device

Figure 3A:
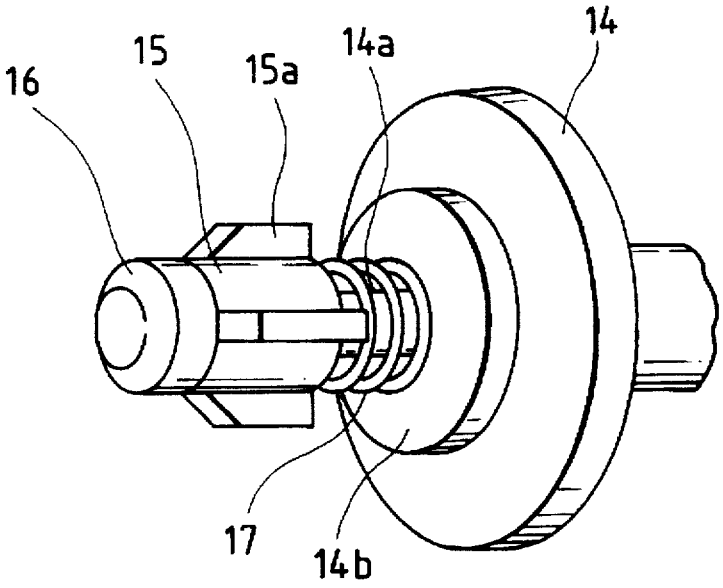
FIGS. 3A and 3B are an assembled view of a supply reel driving device and a cross-sectional view thereof.
Figure 3B:
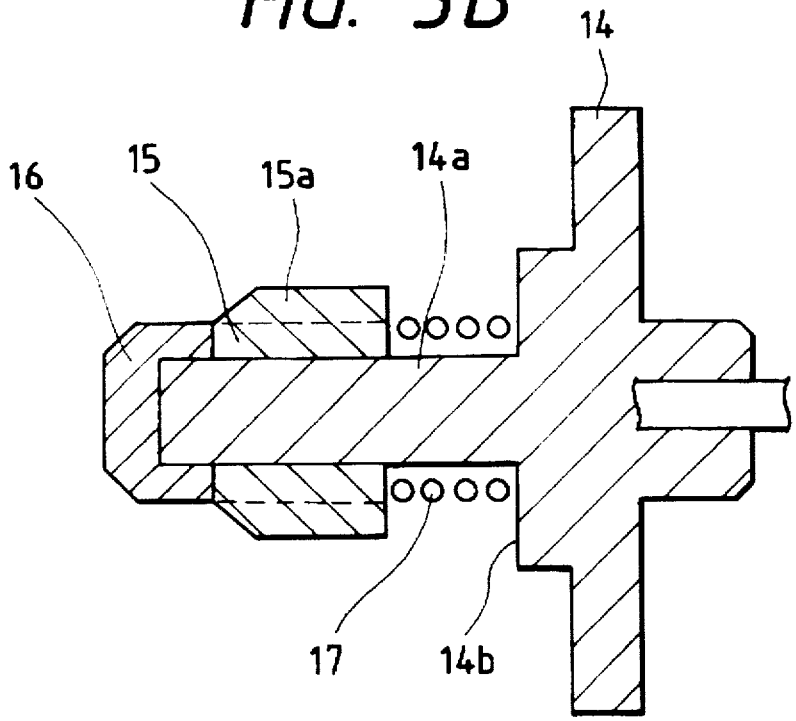

The supply reel driving device which drives the holder 33 fitting in the foregoing supply reel 30 is provided as shown in FIGS. 3A and 3B with a reel driving shaft 14 having in its center a polygonal shaft 14*a* and an abutting portion 14*b* on which the leading end 33*a* of the holder 33 abuts; a sliding member 15 the inner contour of which is polygonal corresponding to the shaft 14*a* so that it fits and slides freely along the outer circumference of the shaft 14*a* in the longitudinal direction, and which also has the nails 15*a* engaging with the coupling nails 33*b* of the holder 33 in the radial direction to stop them; a spring 17 which gives a one-way bias to the sliding member 15; and a fixing member 16 mounted on the shaft 14*a* which engages with the leading end of the sliding member 15 to hold it.

The above-mentioned driving shaft 14 is structured so that a constant load is given thereto when rotating, and that a constant tension is provided for the ink sheet 2 which is drawn from the supply reel 30. Also, the sliding member 15 fitting in the foregoing reel driving shaft 14 is arranged in order to make it easier to engage with the holder 33, and when the sliding member 15 and the coupling nails 33*b* engage with each other, the sliding member 15 slides while rotating slightly for releasing the contact between the nails 15*a* and the coupling nails 33*b* even if these nails abut upon each other, and complete the intended engagement because there is a space between the inner diameter of the sliding member 15 and the outer diameter of the shaft portion 14*a* of the reel driving shaft 14.

(4) Description of the Winding Reel Driving Device

Figure 5A:
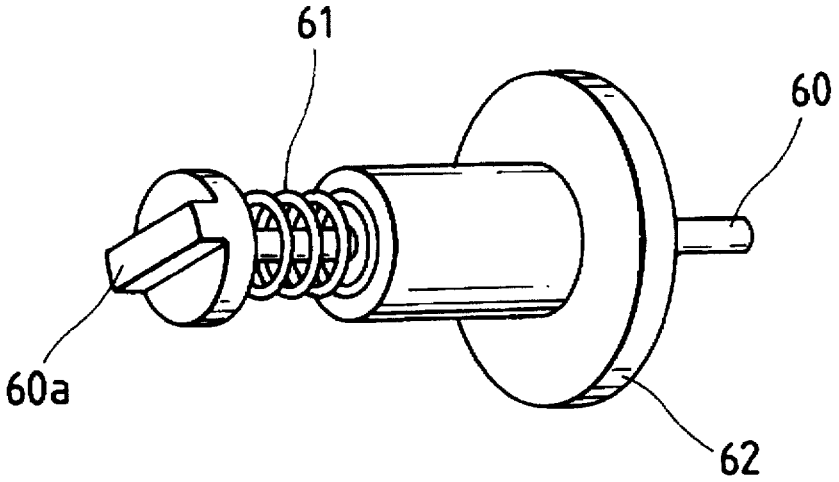
FIGS. 5A and 5B are an assembled view of a winding reel driving device and a cross-sectional view thereof.
Figure 5B:
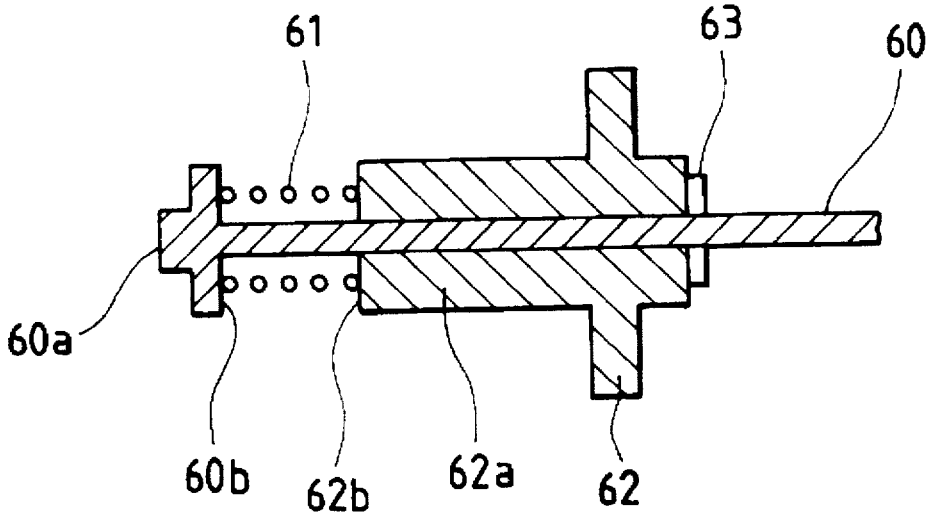

The winding reel driving device which engages with the coupling nails 34*a* on one end side of the foregoing pinion gear 34 and drives the winding reel 31 is provided as shown in FIGS. 5A and 5B with the winding reel driving shaft 60 having a rectangular nail 60*a* in its center; a spring 61 which gives a one-way bias to the winding reel driving shaft 60; a bearing 62 having a bearing portion 62*a* which allows the winding reel driving shaft 60 to fit in it slidably in the longitudinal direction, and supports it rotatively in the circumferential direction; and a fixing member 63 mounted on the shaft portion of the winding reel driving shaft 60.

Here, the arrangement is made so that a rotational force is given to the foregoing winding reel driving shaft 60 through a driving force transmission system which is not shown, and that the ink sheet 2 is wound up around the winding reel 31 when recording. On the other hand, it is arranged that a constant load is exerted on the winding reel driving shaft 60 when rotating, and that a constant tension is given to the ink sheet 2 which is drawn from the supply reel 30. Also, the foregoing spring 61 giving the one-way bias to the winding reel driving shaft 60 is arranged in order to make it easier to engage with the coupling nails 34*a* provided on one end of the pinion gear 34, and when the rectangular nail 60*a* and coupling nails 34*a* engage with each other, the winding reel driving shaft 60 slides in the longitudinal direction while rotating slightly for releasing the contact between the rectangular nail 60*a* and the coupling nails 34*a* even if these nails abut upon each other, and complete the intended engagement because there is a space between the end face 60*b* of the nail 60*a* and the end face 62*b* of the bearing 62.

(5) Description of the Lead Driving Device

Figure 6A:
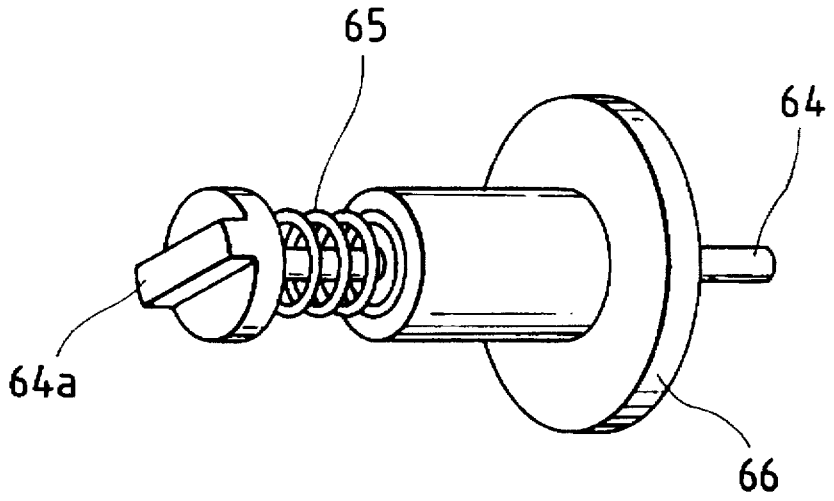
FIGS. 6A and 6B are an assembled view of a lead driving device and a cross-sectional view thereof.
Figure 6B:
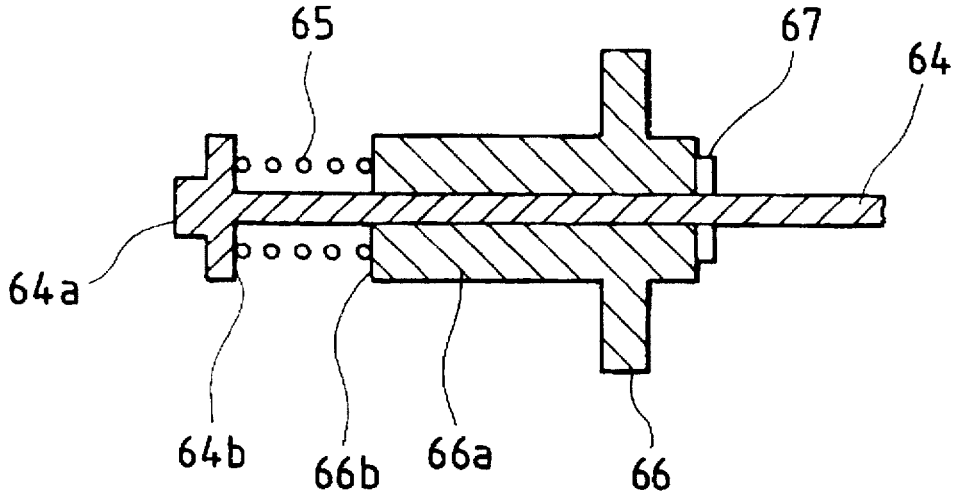

The lead driving device fitting in the coupling nails 35*a* provided on the one end of the foregoing sprocket 35 for feeding the lead 70 is provided as shown in FIGS. 6A and 6B with the sprocket driving shaft 64 having a rectangular nail 64*a* in its center; a spring 65 which gives a one-way bias to the sprocket driving shaft 64; a bearing 66 having a bearing portion 66*a* which allows the sprocket driving shaft 64 to fit in it slidably in the longitudinal direction, and supports it rotatively in the circumferential direction; and a fixing member 67 mounted on the shaft portion of the sprocket driving shaft 64.

Here, the arrangement is made so that a rotational force is given to the foregoing sprocket driving shaft 64 through a driving force transmission system which is not shown, and that the lead 70 stored in the supply reel 30 is fed to the winding nails 31*c* provided for the cylindrical portion 31*b* of the winding reel 31. Also, the foregoing spring 65 giving the one-way bias to the sprocket driving shaft 64 is arranged in order to make it earlier to engage with the coupling nails 35*a* provided on one end of the sprocket 35, and when the rectangular nail 64*a* and coupling nails 35*a* engage with each other, the sprocket driving shaft 64 slides in the longitudinal direction while rotating slightly for releasing the contact between the rectangular nail 64*a* and the coupling nails 35*a* even if these nails abut upon each other, and complete the intended engagement because there is a space between the end face 64*b* of the nail 64*a* and the end face 66*b* of the bearing 66.

In this respect, this lead driving device is of the structure which is almost the same as the foregoing winding reel driving device, but the revolution to be transmitted is the difference between them. It has a relationship of the lead driving device < the winding reel driving device.

Figure 7A:
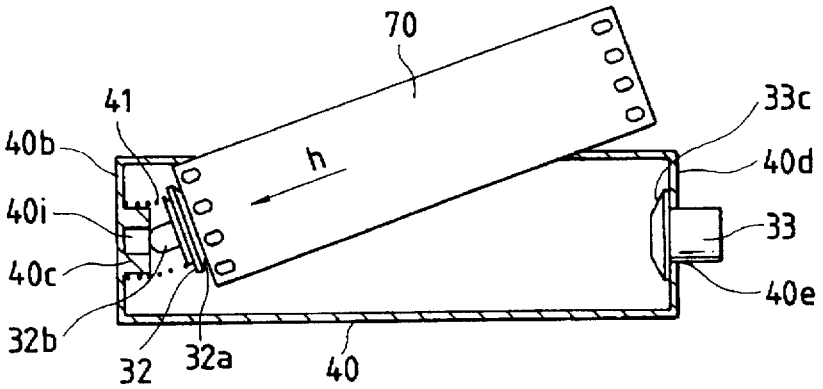
FIGS. 7A to 7D are cross-sectional views showing the procedures to install a supply reel in an ink sheet cassette A.
Figure 7B:
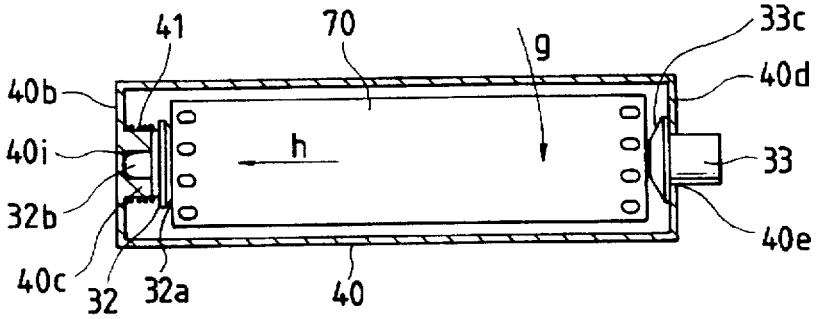
Figure 7C:
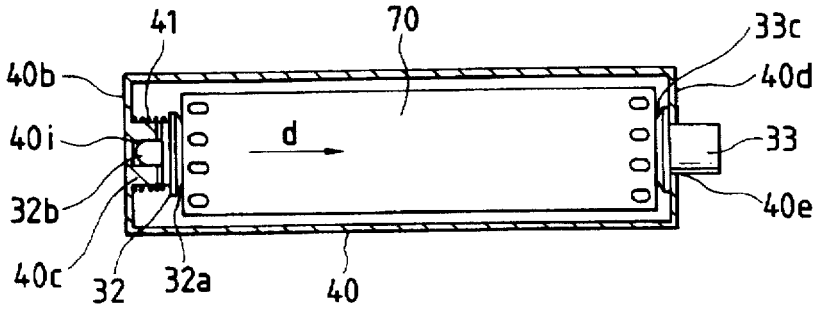
Figure 7D:
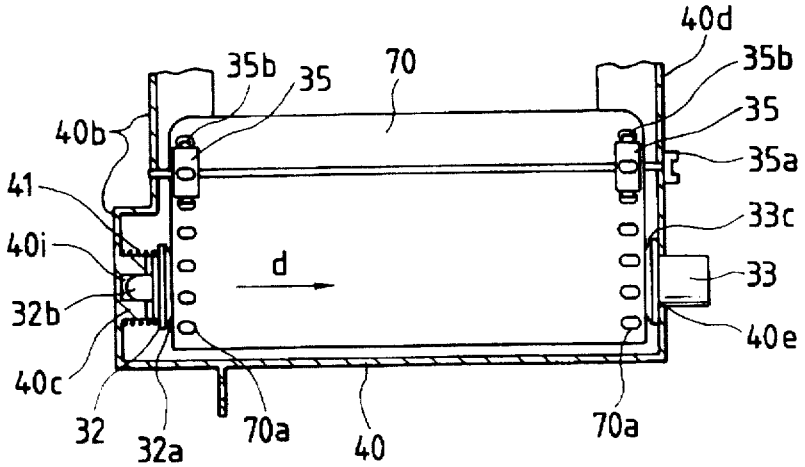

(6) Description of the Installation of the Supply Reel in the Ink Sheet Cassette A FIGS. 7A, 7B, 7C, and 7D are cross-sectional views illustrating the procedure with which to install the foregoing supply reel in the ink sheet cassette A. The mode of the supply reel before the installation in the ink sheet cassette A is that the lead 70 is wound around the outermost circumference of the ink sheet 2 as shown in FIG. 2B, so that the protection of the ink sheet and the improvement of its handling are implemented. Also, the lead 71 is wound around the innermost circumference of the ink sheet 2 to maintain the holding of the ink sheet. As shown in FIG. 7A, a pivot 32 is fixed to an extrusion 40*c* on the wall side 40*b* of a case 40 through a spring 41. Also, on the wall side 40*d* on the other side of the case 40, a holder 33 is rotatively supported in a hole 40*e*. At first an operator inserts the supply reel 30 into the tapered part 32*a* of the pivot 32 in the direction indicated by an arrow h. This tapered part 32*a* fits in the end face of the inner diameter 71*b* of the lead 71 of the supply reel 30. Since the pivot 32 is supported by the spring 41 rockingly, the reel 30 can be inserted easily while inclining it. Also, the pivot 32 is supported by the spring 41 so that the supply reel 30 can slide slightly in the longitudinal direction. While keeping the depression in the direction indicated by an arrow h, the operator installs the supply reel 30 in the direction indicated by an arrow g as shown in FIG. 7B. When the depression exerted in the direction indicated by an arrow h is released, the supply reel 30 is biased in the direction indicated by an arrow d by the force of the spring 41 as shown in FIGS. 7C and 7D. Thus, the end face 71*b* of the inner diameter of the lead 71 of the supply reel 30 is inserted into the tapered part 33*c* of the holder 33. At this juncture, the holes 70*a* of the lead are positioned just above the feeding teeth 35*b* of the sprocket 35.

Figure 9A:
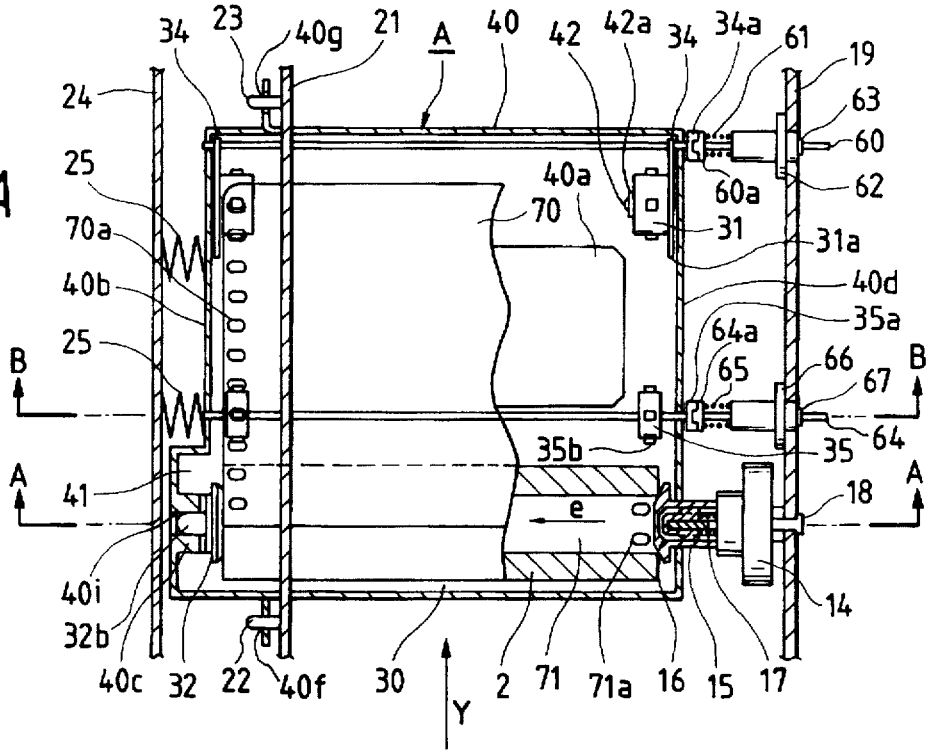
FIGS. 9A to 9C are a cross-sectional view showing a state where the ink sheet cassette A shown in FIG. 1A is installed in a recording apparatus, a cross-sectional view showing a part in FIG. 9A taken along a line A—A and observed in the direction indicated by an arrow Y, and a cross-sectional view showing a part in FIG. 9A taken along a line B—B and observed in the direction indicated by an arrow Y.
Figure 9B:
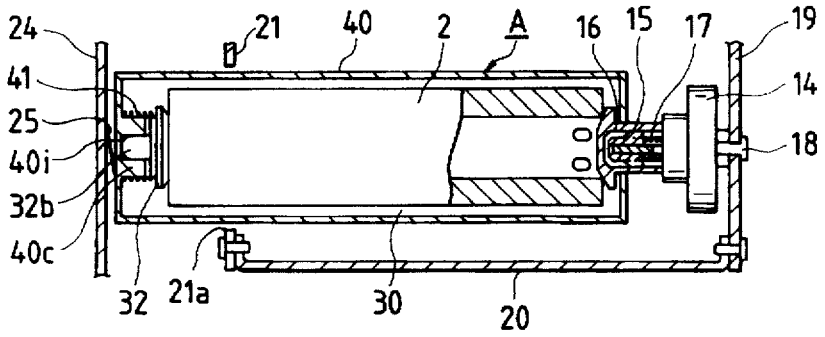
Figure 9C:
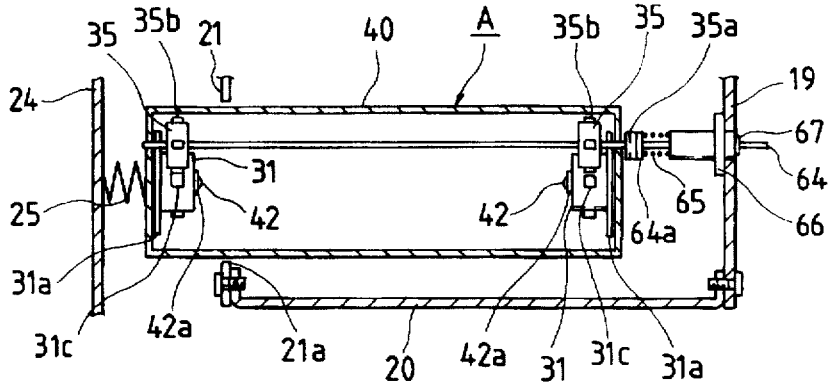

(7) Description of the Installation of the Ink Sheet Cassette A in the Recording Apparatus B FIGS. 9A, 9B, and 9C are cross-sectional views showing the state where the foregoing ink sheet cassette A is installed in the recording apparatus B. As shown in FIGS. 9A and 9B, the cassette installation part of the recording apparatus B is arranged so that the foregoing reel driving shaft 14 is rotatively mounted on a shaft 18 which is fixed on a rear chassis 19.

The above-mentioned rear chassis 19 is fixed to a main chassis 20. To the main chassis 20, a front chassis 21 is fixed. To the front chassis 21, pins 22 and 23 are respectively fixed in two places left and right the hole 21*a* where the ink sheet cassette A is inserted. The pins 22 and 23 fit in the holes 40*f* and 40*g* formed on the case 40 of the ink sheet cassette A. In this respect, the hole 40*g* on one side is elongated. Therefore, the positioning of the ink sheet cassette A to the recording apparatus B is executed by means of the coupling nails 33*b* of the holder 33 of the supply reel 30, the sliding member 15 of the reel driving device, and holes 40*f* and 40*g* of the case 40 and the pins 22 and 23.

Further, on the side wall 40*b* of the case 40 side, a pressure board 24 capable of being opened and closed is arranged, and on this pressure board 24, spring members 25 are mounted. The biasing strength of these spring members 25 is defined stronger than the biasing strength of the spring 41 provided for the ink sheet cassette A. It is then arranged that when the pressure board 24 is closed, the spring members 25 press the side board 40*b* in the vicinity of the place where the spring 41 is provided for the ink sheet cassette A.

Therefore, when the pressure board 24 is closed after the sliding member 15 of the supply reel driving device has been inserted in the holder 33 which fits in the supply reel 30 of the ink sheet cassette A, the abutting part 14*b* is caused to abut upon the end face 33*a* of the holder 33 by the biasing force of the spring members 25, and at the same time, the supply reel 30 is biased in the direction indicated by an arrow e in FIG. 9A. In this way, the supply reel 30 slides in the direction indicated by the arrow e so that the end face 33*b* which has abutted on the inner surface of the side wall 40*d* of the case 40 is caused to be released, hence allowing the supply reel 30 to be rotative. Then, in this respect, the arrangement is made so that the extrusion 32*b* of the pivot 32 is caused to abut on the bottom of the. recess 40*i* inside the extrusion 40*c*, and the positions in the longitudinal and circumferential directions of the reel are determined.

Also, at the same time, the nail 34*a* at the end on the one side of the pinion gear 34 which drives the winding reel 31, the nails 35*a* at the end on the one side of the sprocket 35 which feeds the lead 70, the nails 60*a* of the winding reel driving shaft 60, and the nails 64*a* of the sprocket driving shaft 64 are coupled, thus enabling the driving forces from the winding reel driving device and the lead driving device to be transmitted.

(8) Description of the Operation to Install the Lead for the Recording Apparatus B FIGS. 8A, 8B, 8C, and 8D are cross-sectional views illustrating the operation to wind up the lead of the foregoing supply reel around the winding reel of the ink sheet cassette A.

Figure 8A:
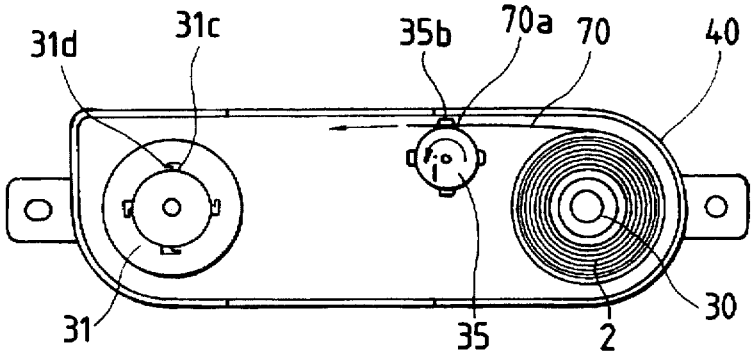
FIGS. 8A to 8D are cross-sectional views illustrating the operation to wind the lead of a supply reel around the winding reel of an ink sheet cassette A.

The supply reel installed in the ink sheet cassette A has the holes 70*a* of the lead 70 positioned just above the feeding teeth 35*b* of the sprocket 35 as shown in FIG. 8A.

Figure 8B:
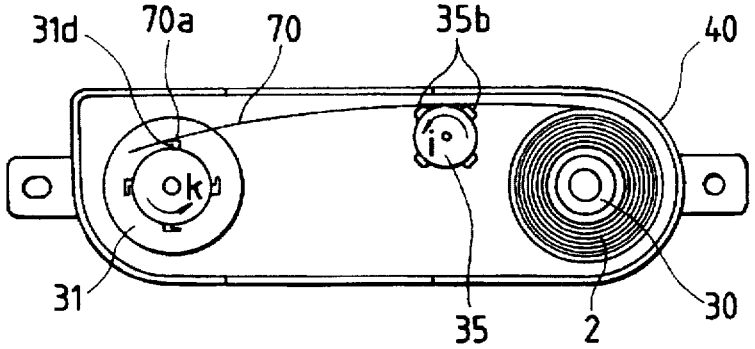
Figure 8C:
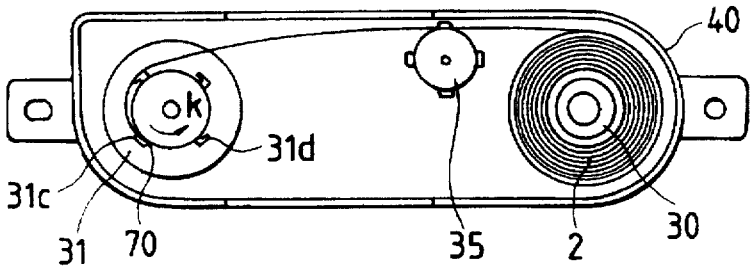
Figure 8D:
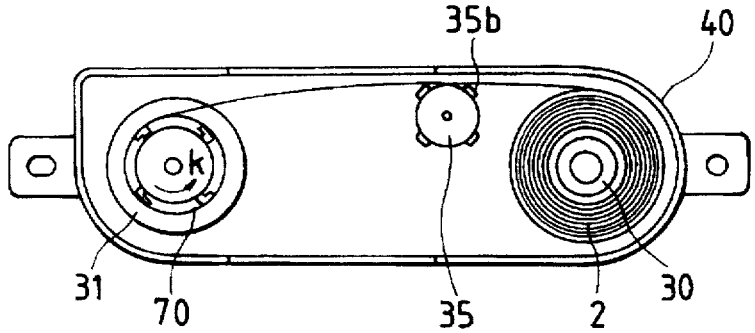

Here, when the sprocket 35 is rotated in the direction indicated by an arrow i by transmitting the force from the lead driving device thereto, the lead 70 is conveyed in the direction indicated by an arrow j. Then, the lead driving device suspends the rotation when the holes 70*a* of the lead 70 reach the position just above the winding nails 31*c* arranged on the cylindrical part 31*b* of the winding reel 31 as shown in FIG. 8B. Subsequently, the force from the winding reel driving device is transmitted to the winding reel 31 to rotate it in the direction indicated by an arrow k. The holes 70*a* of the lead 70 which have been conveyed by the lead driving device are allowed to engage with the winding nails 31*c* arranged on the cylindrical part 31*b* of the winding reel 31. Thus, as shown in FIG. 8C, the lead 70 is wound around the cylindrical part 31*b* of the winding reel 31. Further, the winding reel 31 is rotated in the direction indicated by an arrow k in FIG. 8D to wind all the lead 70 around the cylindrical part 31*b* of the winding reel 31.

With the operation mentioned above, the lead 70 is integrated with the winding reel 31, making it possible to wind up the ink sheet to be used along the recording operation of the recording apparatus B.

(9) Description of the Recording Operation of the Recording Apparatus B

Figure 10A:
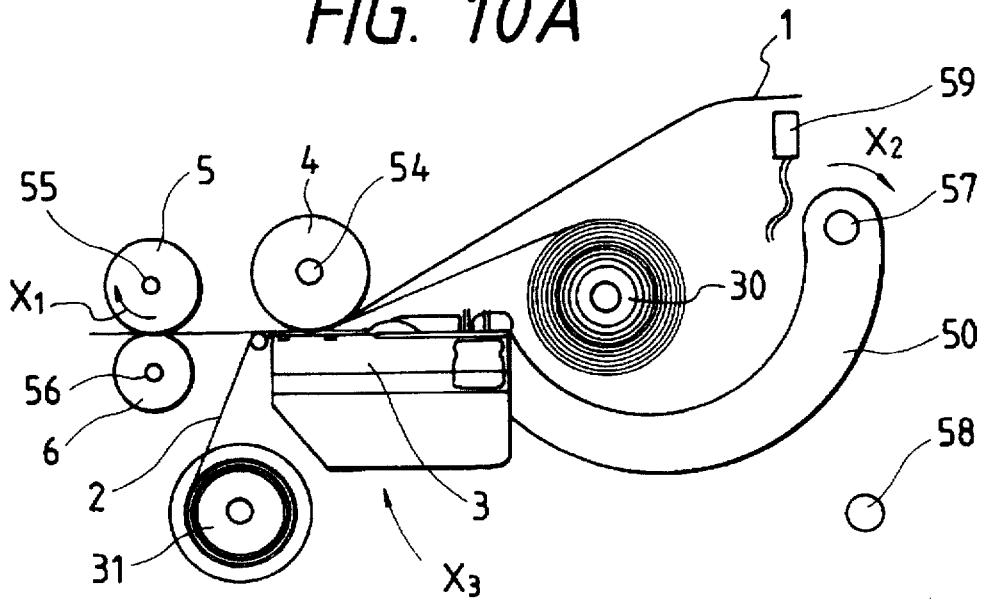
FIGS. 10A and 10B are views illustrating the structure of the recording unit of the aforesaid recording apparatus.
Figure 10B:
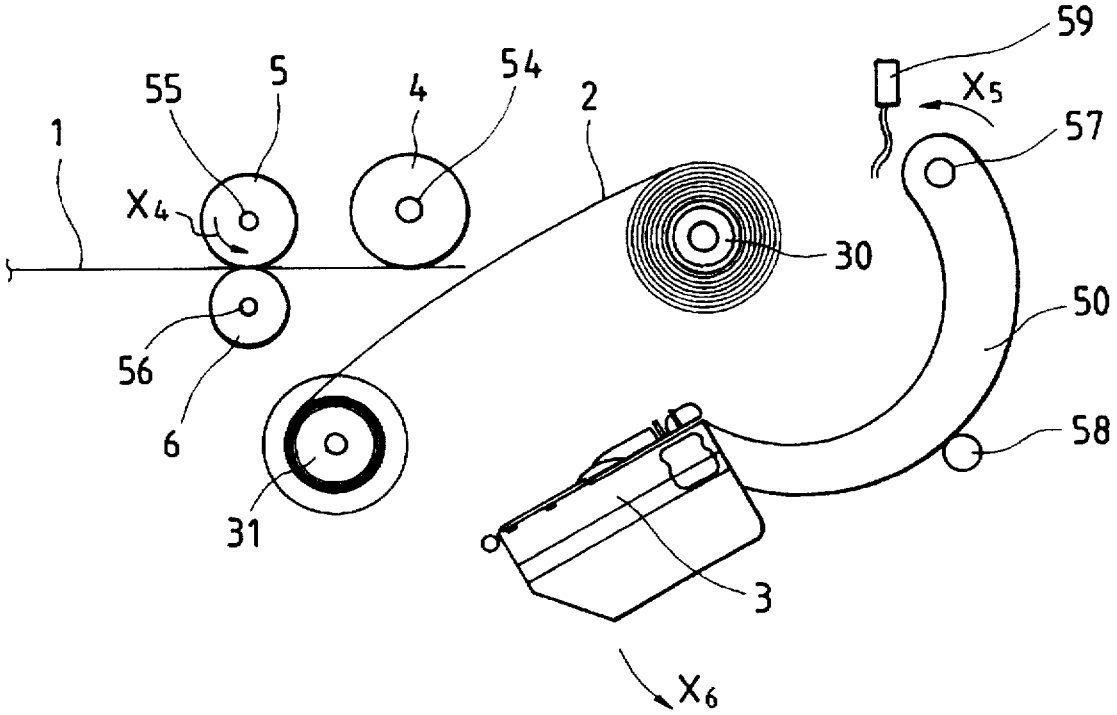

FIGS. 10A and 10B are views schematically illustrating the structure of the recording apparatus B in which the ink sheet cassette A is installed. In FIGS. 10A and 10B, a thermal head 3 is mounted on a supporting arm 50 which is rotative together with a shaft 57 around the shaft 57 rotatively mounted on a chassis (not shown). A platen roller 4, a driving roller 5, and pressure roller 6 are integrally mounted, respectively, on the shafts 54, 55, and 56 rotatively mounted on the chassis (not shown). A reference numeral 58 designates a stopper which is mounted on the chassis (not shown). The stopper 58 is arranged to abut on the supporting arm 50. A reference numeral 59 designates a sensor which detects the leading end of a recording sheet 1.

With the structure mentioned above, the thermal head 3 is pressed to the platen roller 4 by the rotational movement of the supporting arm 50 with the recording sheet 1 and an ink sheet 2 pinched between them.

Now, its operation will be described.

The recording sheet 1 is conveyed by means of the driving roller 5 and the pressure roller 6 to the position where its leading end is detected by the sensor 59. When a first color portion (yellow, for example) of the ink sheet 2 is set at the starting position of recording, the first color portion is ready for recording.

Here, as shown in FIG. 10A, the driving roller 5 is rotated in the direction indicated by an arrow $x_1$ while the recording sheet 1 is being pinched by the driving roller 5 and pressure roller 6. Also, the shaft 57 is rotated in the direction indicated by an arrow $x_2$ by a supporting arm driving unit which is not shown. Since the supporting arm 50 is integrally formed with the shaft 57, the arm is rotated in the direction indicated an arrow $x_3$. Thus, the thermal head 3 mounted on the supporting arm 50 presses the platen roller 4 so that the recording sheet 1 and the ink sheet 2 are pinched. When recording signals are given to the thermal head 3 in this state, the coloring matter (yellow) on the ink sheet 2 is transferred to the recording sheet 1 by the heat generated by the thermal head 3. With this, the first color recording begins and will continue to the very last end. During this period, the ink sheet 2 is wound up by the winding reel 31, and shifted at the shifting speed of the recording sheet 1. In this respect, as a torque limiter is incorporated in the supporting arm driving unit which is not shown, the thermal head 3 is allowed to press the platen roller 4 with a given constant force by means of this torque limiter.

In this way, the first color recording is completed. Then, as shown in FIG. 10B, the driving roller 5 is rotated in the direction indicated by an arrow $x_4$. Also, the shaft 57 is rotated by the supporting arm driving unit which is not shown in the direction indicated by an arrow $x_5$. Thus, the supporting arm 50 is rotated in the direction indicated by an arrow $x_6$ to cause the thermal head 3 to retract from the platen roller 4. When the supporting arm 50 abuts upon the stopper 58, the supporting arm driving unit which is not shown releases the transmission force to the shaft 57 so that the supporting arm 50 is held in the position where it abuts on the stopper. The driving roller 5 is continuously rotated in the direction indicated by the arrow $x_4$ to convey the recording sheet 1 in cooperation with the pressure roller 6, and stop it in the position where the leading end of the recording sheet 1 is detected by the sensor 59. Also, during this period, the ink sheet 2 is wound up by the winding reel 31, which will stop when a second coloring matter on the ink sheet 2 arrives at the position where the recording begins.

Subsequently, as described above, the driving roller 5 is rotated in the direction indicated by the arrow $x_1$ to cause the thermal head 3 to press the platen 4 as in the state shown in FIG. 10A, thus the second color recording begins. Thereafter, a third color recording is made in the same manner, and then, one image recording will be completed.

As described above, each time the image recording is made, the ink sheet 2 is wound up by the winding reel 31. After the recording on a given number of recording sheets is completed, the ink sheet 2 is further wound up. Then, the lead 71 provided for the very last end of the ink sheet 2 is wound around the winding reel 31. The operator removes the lead 70 integrated with the winding reel 31 from the ink cassette A in a state that the lead 71 has been completely wound around the winding reel 31. When removing, the holes 70*a* of the lead 70 are drawn out from the winding nails 31*c* provided for the cylindrical part 31*b* of the winding reel 31, and then, the lead 70 is removed from the cylindrical part 31*b* of the winding reel 31.

In this respect, according to the present embodiment, the holes 70*a* of the lead 70 are formed at equal intervals and are allowed to engage with the sprocket 35 for conveying the ink sheet 2, and further, the ink sheet is wound up by enabling the holes to engage with the winding nails 31*c* of the winding reel 31. However, it may be possible to abolish the holes 70*a* of the lead 70, and use rubber rollers instead for the sprocket 35 and the cylindrical part 31*b* of the winding roller 31 to feed and wind the ink sheet under pressure.

(Second Embodiment)

Now, with reference to FIGS. 11A, 11B, 12A, and 12B, the description will be made of another embodiment of the recording apparatus of the foregoing first embodiment. Here, (1) the schematic structure of the recording apparatus, (4) winding reel driving device, (5) lead driving device, (8) the description of the installation of the lead in the recording apparatus, and (9) the description of recording operation of the recording apparatus are the same as the foregoing embodiment. Therefore, the same reference numerals are provided for the same members, and the description thereof will be omitted.

(1) The Structure of the Ink Sheet

Figure 12A:
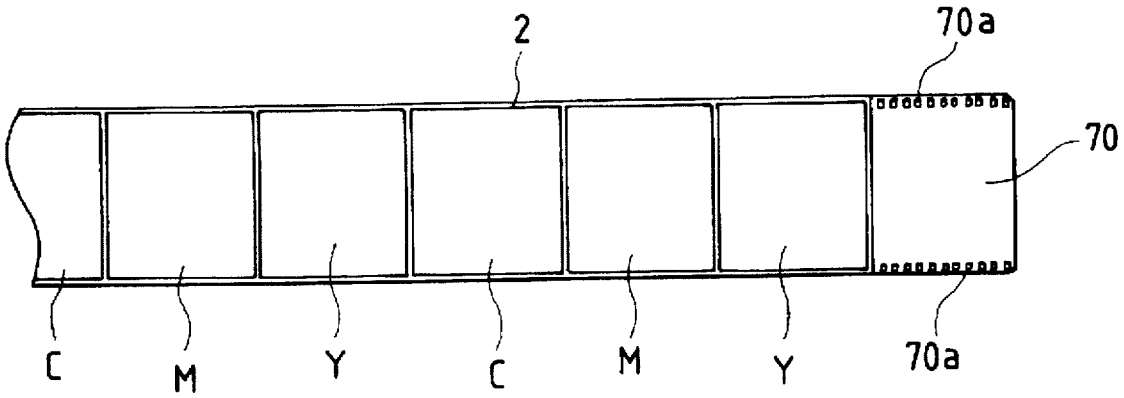
FIGS. 12A and 12B are a plan view showing an ink sheet and lead according to another embodiment, and a perspective view thereof.
Figure 12B:
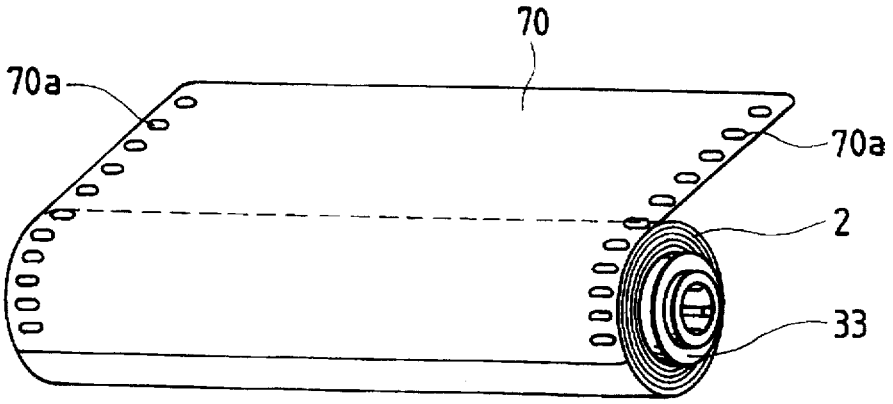

As shown in FIG. 12A, the ink sheet 2 is a transfer sheet on which coloring matters, Y (yellow), M (magenta), and C (cyanogen), are coated in the respective sections in that order, and one end thereof is connected to the supply reel which will be described later, while the other end (free end) has a lead 70 bonded thereto as the guiding member. Also, the mode of the above-mentioned ink sheet 2 before its installation in the ink sheet cassette A is that the lead 70 is wound around the outermost circumference of the ink sheet 2 as shown in FIG. 12B in order to implement the protection of the ink sheet and the provision of its easier handling. It is then arranged that this ink sheet cassette A can be detachably installed in the apparatus main body 10.

(2) Description of the Structure of the Ink Sheet Cassette A

Figure 11A:
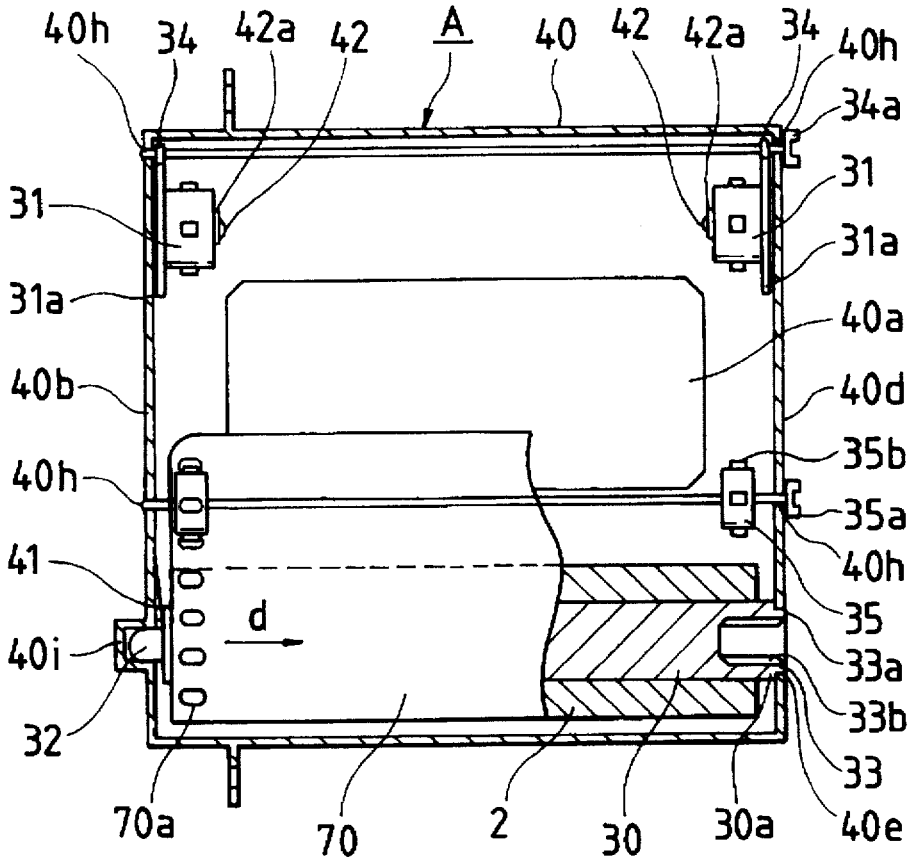
FIGS. 11A and 11B are a cross-sectional view showing an ink sheet cassette used for a recording apparatus according to another embodiment, and a view illustrating a part installed therein.
Figure 11B:
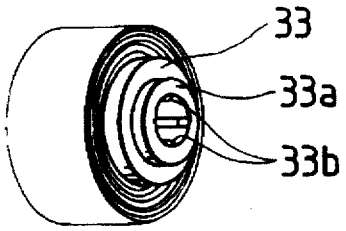

FIG. 11A is a cross-sectional view illustrating the ink sheet cassette A in which the supply reel having an ink sheet wound around it as a strap member is installed. FIG. 11B is a perspective view showing one end of the supply reel shown in FIG. 11A which engages with the supply reel driving device to be described later.

In FIG. 11A, the elongated ink sheet 2 is wound around the supply reel 30 which is a molded product. To the free end of the sheet, a lead 70 is bonded. The lead 70 is wound around the winding reels 31 (on both sides) by the winding reel driving device which will be described later, and serves as a winding member. The above-mentioned supply reel 30 is installed in a case 40 in a state that the reel has wound up the ink sheet 2. Also, the above-mentioned winding reel 31 is rotatively supported by the shaft 42 which is arranged in the case 40.

At the one end of the above-mentioned supply reel 30 in the longitudinal direction, a pivot 32 is formed, while at the other end, a small diameter hollow cylindrical part 33 is formed as shown in FIG. 11B. Then, on the- inner circumference of the hollow cylindrical part 33, a coupling nail 33*b* is formed. This coupling nail 33b is arranged to engage with the supply reel driving device which will be described later.

The case 40 which receives the foregoing supply reel 30 has a recording window 40a in the central part thereof as shown in FIG. 11A to allow the ink sheet 2 to be exposed. On a side wall 40b on its one side (left-hand side in FIG. 11A), a recess 40i is formed to rotatively support the pivot 32 of the supply reel 30. This recess 40i is so formed that it has a depth allowing the supply reel 30 to be slightly slidable in the longitudinal direction.

Also, on a wall side 40d on the other side (right-hand side in FIG. 11A) of the case 40, a hole 40e is formed, which is capable of receiving the small diameter hollow cylindrical part 33 of the supply reel 30. The inner diameter of this hole 40e is formed larger than the outer diameter of the small diameter hollow cylindrical part 33.

Then, on the inner plane of the foregoing side wall 40b, a flat spring 41 is mounted. By this flat spring 41, the supply reel 30 is biased in the direction indicated by an arrow d in FIG. 11A. By this biasing force, the end face 30a of the supply reel 30 is caused to abut on the inner face of the side wall 40d on the other side of the case 40. Thus, by the frictional force between them, the rotation of the supply reel 30 is regulated. Therefore, when the cassette A is removed from the recording apparatus B, the supply reel does not rotate idle. The ink sheet 2 does not slack, either, accordingly.

In this respect, the supply reel 30 slides by the biasing force of the flat spring 41 in the direction indicated by the arrow d in FIG. 11A, but it is arranged that the pivot 32 does not fall off from the recess 40i at that time.

(4) Description of the Installation of the Supply Reel in the Ink Sheet Cassette A At first an operator inserts the pivot 32 of the supply reel 30 into the foregoing recess 40i in the direction indicated by an arrow h. This recess 40i is formed in a depth good enough to allow the supply reel 30 to slide in the longitudinal direction. While maintaining the depression in the direction indicated by the arrow h, the operator installs the supply reel 30 in the direction indicated by an arrow h as shown in FIG. 7B. When the depression in the direction indicated by the arrow h is released, the supply reel 30 is biased in the direction indicated by the arrow d by the flat spring 41 mounted on the inner face of the foregoing side wall 40b as shown in FIGS. 7C and 7D. The outer diameter of the small diameter hollow cylindrical part 33 is inserted into the inner diameter of the foregoing hole 40e. At this juncture, the holes 70a of the lead are positioned just above the feeding teeth 35b of the sprocket 35.

(5) Replacing Operation of Ink Sheets after Recording

After recording the ink sheet 2 is wound up by the winding reel 31, and when the recording for a given number of recording sheets is completed, the operator removes from the cassette A the supply reel 30 and the lead 70 integrated with the winding reel 31 which has the used ink sheet wound around it. When removing, the holes 70a of the lead 70 are drawn out from the winding nails 31c provided for the cylindrical part 31b of the winding reel 31. Then, the lead 70 is removed from the cylindrical part 31b of the winding reel 31, and a new supply reel 30 is installed.

In the above-mentioned first embodiment, the lead 70, or the first guiding member, and the lead 71, or the second guiding member, bonded to both ends of the ink sheet, respectively, serve as substitutes for the winding reel and supply reel. In other words, the ink sheet before use is in a state that it is wound around the second guiding member which is a substitution for the supply reel. Also, the ink sheet after use is wound around the first guiding member which is a substitution for the winding reel. Therefore, any supply reel and winding reel are not needed. Thus, the parts can be reduced, and the intended adoption of inexpensive materials can be implemented at the same time.

Also, it is possible to repeatedly use the cassette in which the ink sheet is installed. The unit price of the ink sheet thus becomes low, leading to the implementation of lowering the total cost of the recording apparatus which uses the above-mentioned cassette.

Further, the supply reel and winding reel which have hitherto been discarded after use are no longer needed. Therefore, it is possible to obtain a recording apparatus with a consideration given to the promotion of the resource saving as well as the environmental protection.

As described above, according to the second embodiment, the supply reel having an ink sheet wound around it is installed in the cassette, and the guiding member bonded to the free end of the ink sheet serves as the winding member of the winding reel which winds up the ink sheet. Therefore, the used ink sheet is discarded together with the guiding member serving as the winding member, and then, the cassette and the empty-cored supply reel become reusable. Accordingly, the unit price of the cassette can be lowered, leading to the implementation of lowering the total cost of the recording apparatus which uses such a cassette.

Also, since the cassette and the empty-cored supply reel can be reused, it is possible to obtain a recording apparatus for which the environmental protection is considered with respect to the life cycle (manufacturing→using→collecting→recycling) of the apparatus.

The first embodiment and the second embodiment set forth above are of such a structure that no winding reel is needed, while the used ink sheet is discarded. Now, the same structure of some other types will be further described according to a third embodiment and a fourth embodiment set forth below.

(Third Embodiment)

Figure 13:
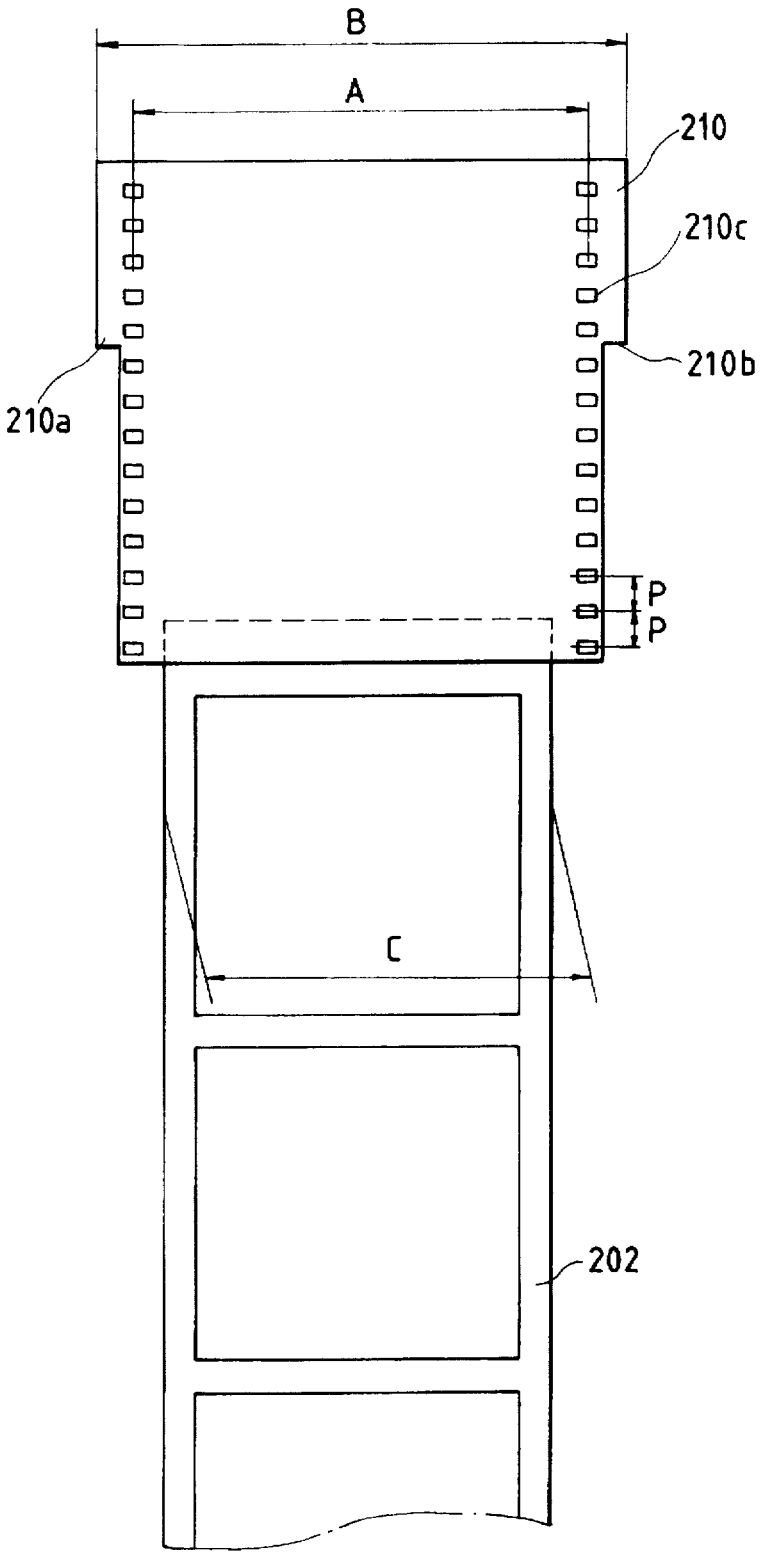
FIG. 13 is a view illustrating a guiding member according to another embodiment.
Figure 14A:
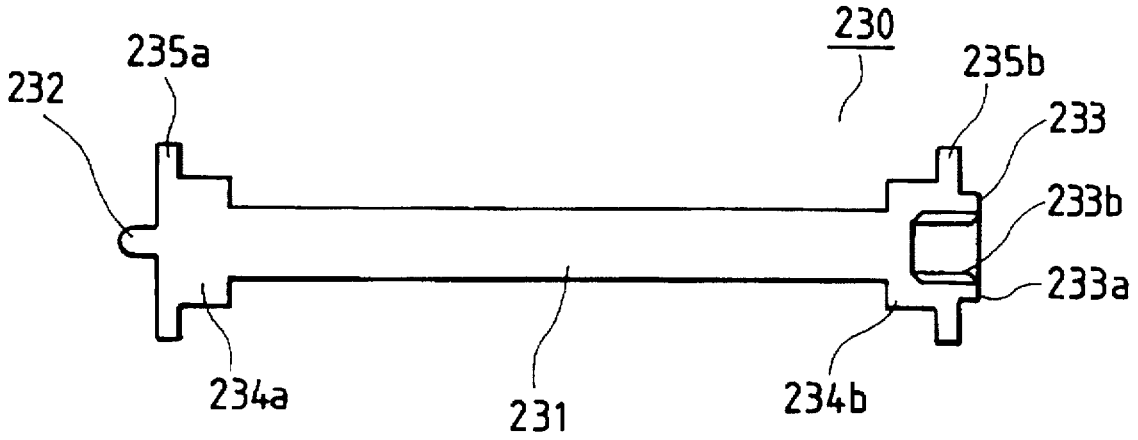
FIGS. 14A and 14B are a cross-sectional view illustrating a reel to wind up a guide member according to another embodiment, and a partially perspective view thereof.
Figure 14B:
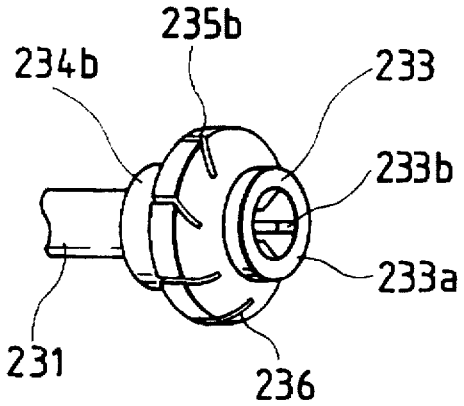
Figure 15A:
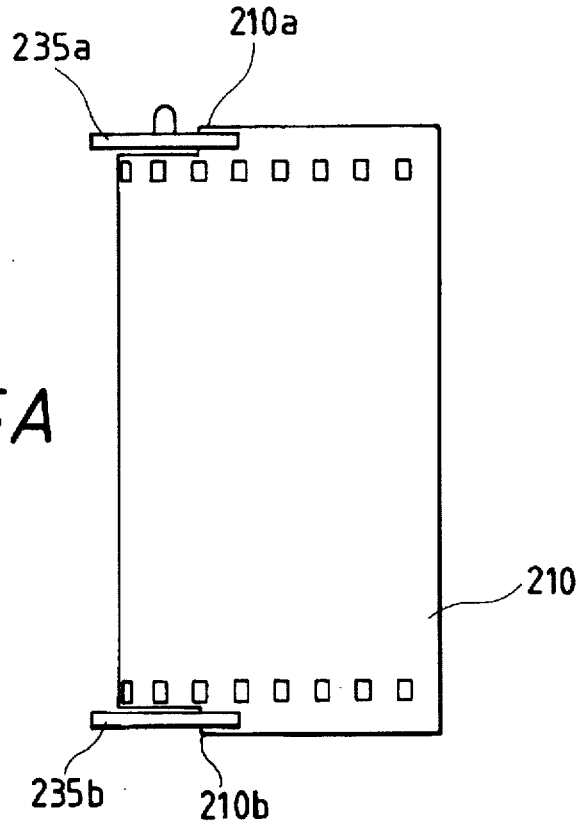
FIGS. 15A to 15C are views illustrating a state where the guiding member showing in FIG. 13 is wound around the reel shown in FIGS. 14A and 14B.
Figure 15B:
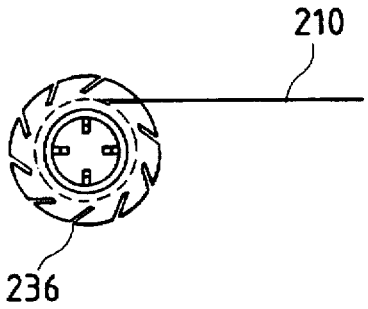
Figure 15C:
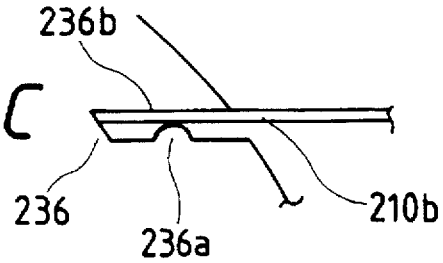
Figure 16A:
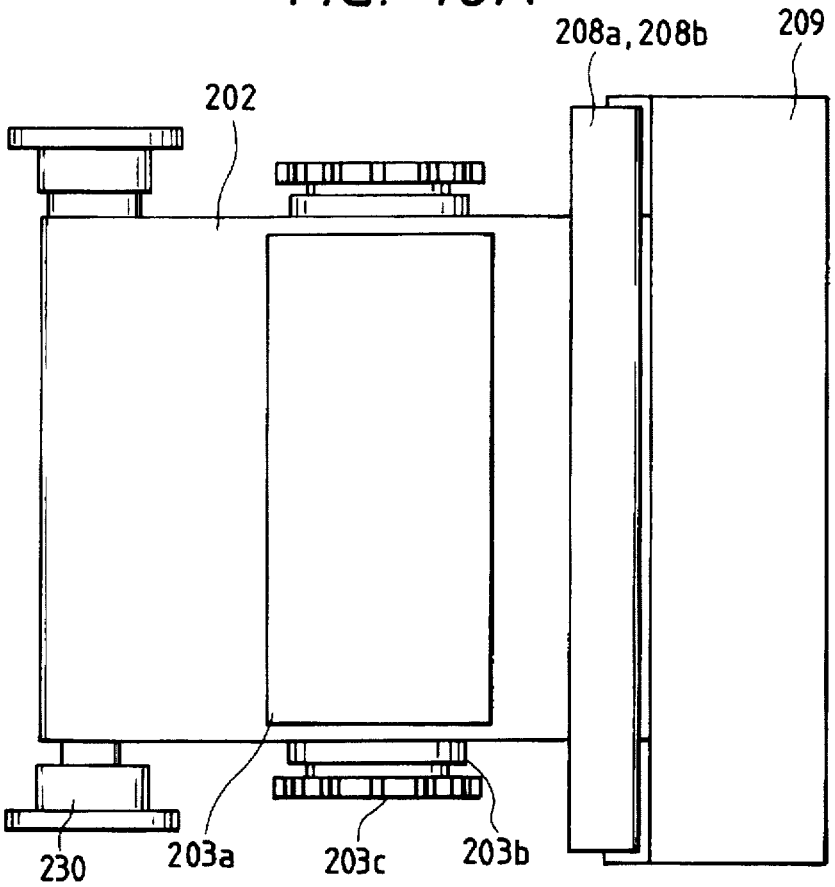
FIGS. 16A and 16B are cross-sectional views schematically showing the recording system of a recording apparatus which executes recording by installing the reel shown in FIGS. 15A to 15C in the recording apparatus.
Figure 16B:
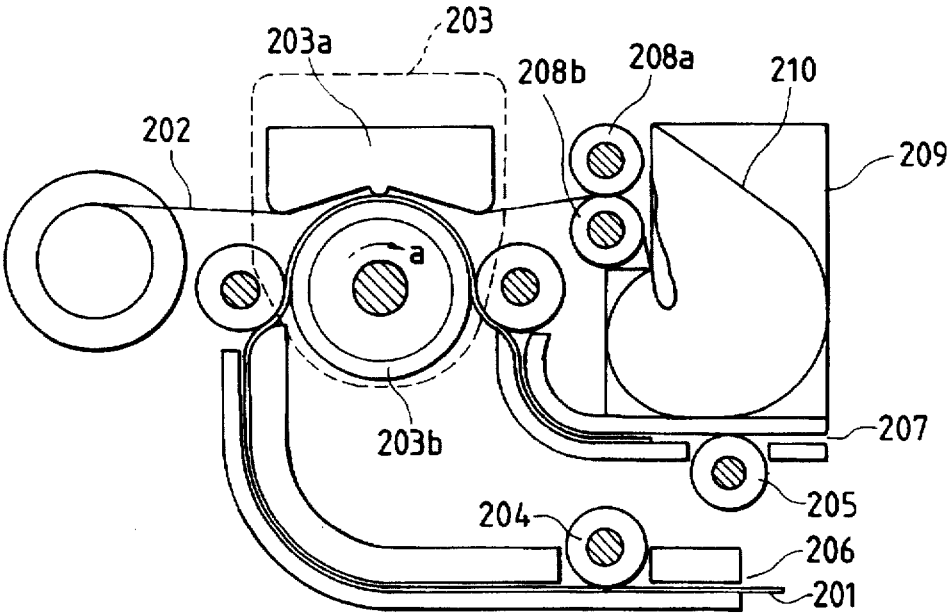
Figure 17A:
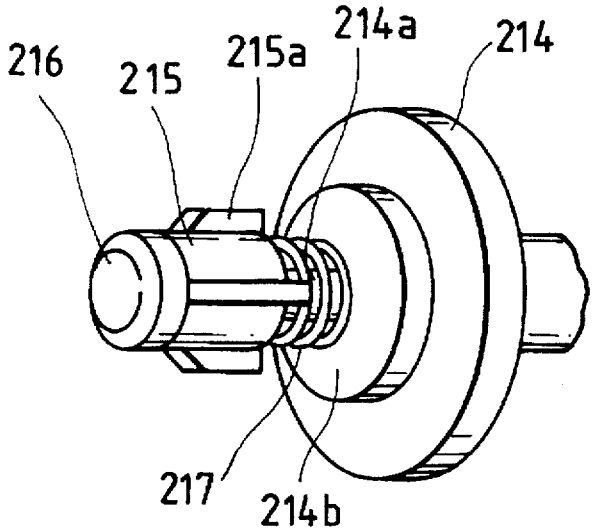
FIGS. 17A and 17B are a perspective view showing a reel base which fits into an ink reel, and a cross-sectional view thereof.
Figure 17B:
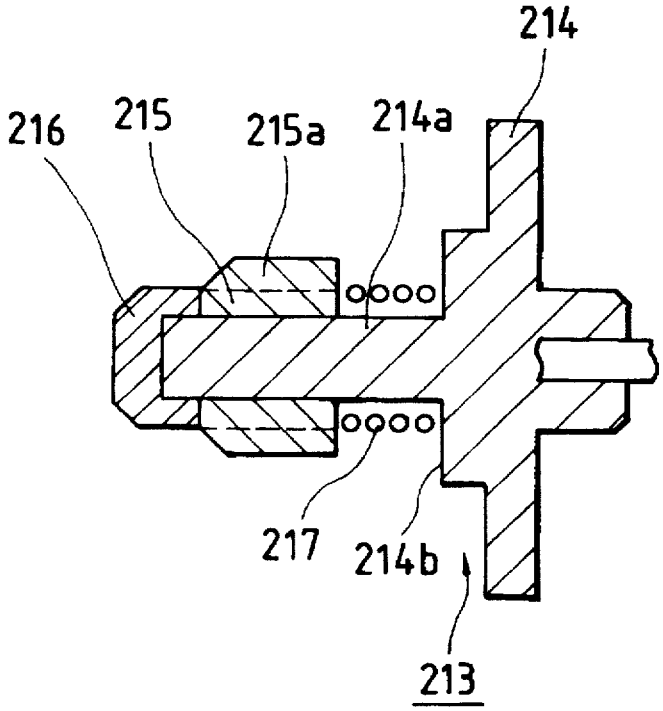
Figure 18A:
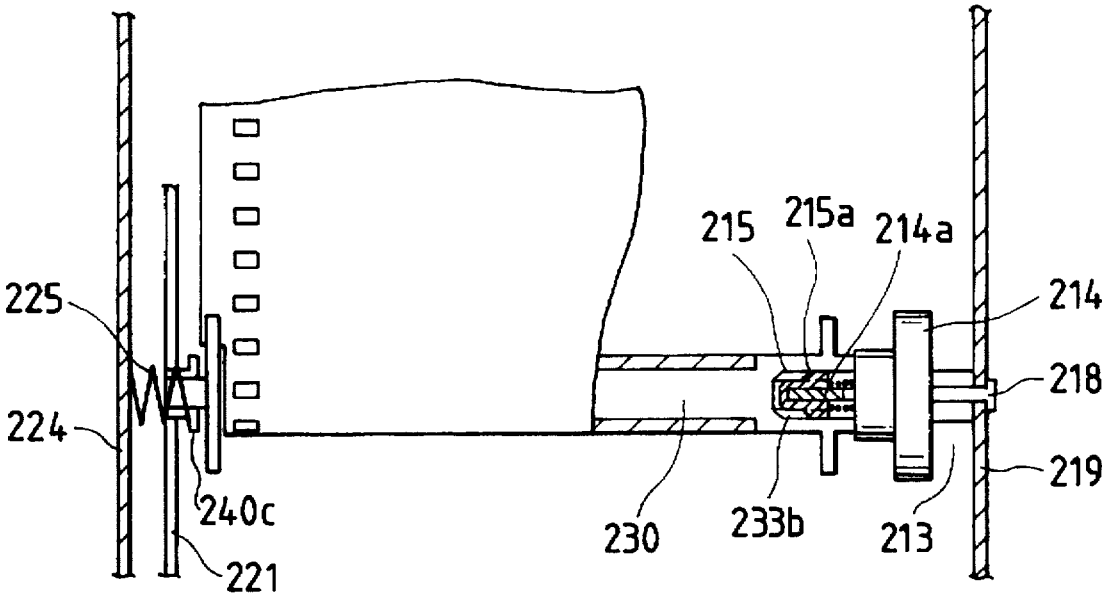
FIGS. 18A and 18B are cross-sectional views showing the ink reel installed in the main body with a guide member wound around it.
Figure 18B:
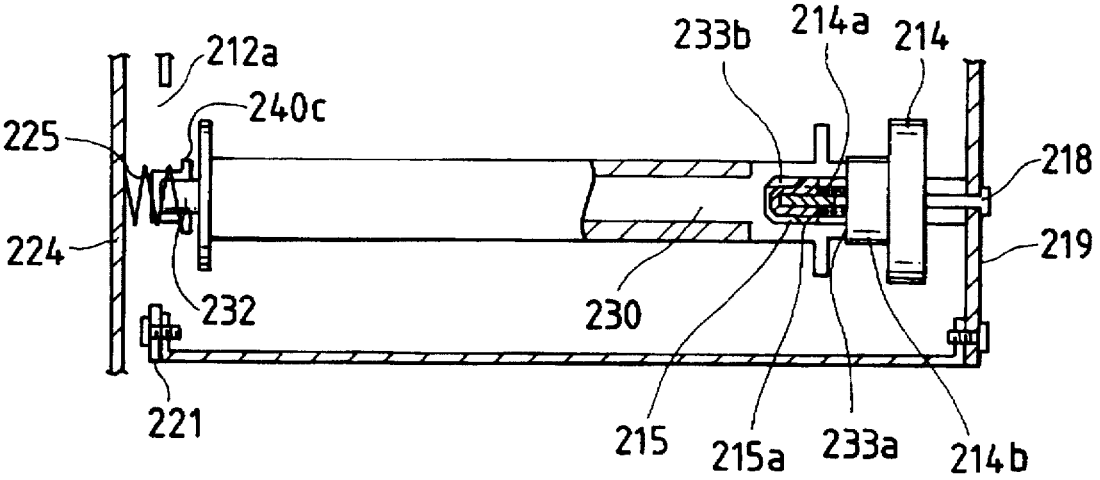

FIG. 13 is a view illustrating an ink sheet as a strap medium, and an ink sheet leader as a guiding member. FIGS. 14A and 14B are a cross-sectional view and a partially perspective view illustrating an ink reel for winding the ink sheet which serves as a guiding member. FIGS. 15A to 15C are views illustrating a state where the ink sheet and ink leader member are wound around the ink reel. FIGS. 16A and 16B are cross-sectional views illustrating the recording system of a recording apparatus which records with the foregoing ink reel installed therein. FIGS. 17A and 17B are a perspective view and a cross-sectional view showing a reel base which fits in the ink reel according to the present embodiment. FIGS. 18A and 18B are cross-sectional views showing the main body installing therein the ink reel having the guiding member of the present embodiment wound around it is installed. FIGS. 19A to 23B are cross-sectional views showing each state that the ink sheet utilizing the guiding member of the present embodiment is being fed automatically.

At first, the description will be made of the structure of the recording system of a thermal transfer recording apparatus with reference to FIGS. 16A and 16B. The recording apparatus is the one which records images on a recording sheet 201 which serves as a recording medium in accordance with image signals transmitted from the other apparatus. In other words, the recording sheet 201 which is inserted from a manual inlet 206 is fed by a feeding roller 204 so that it is wound around a platen 203*b*. Then, a recording head 203*a* constituting recording means 203 presses the superposed recording sheet 201 and the ink sheet 202 which serves as the recording medium to the rotative platen roller 203*b* side. By driving the platen roller 203*b* to rotate in the direction indicated by an arrow a in FIG. 16B, the recording sheet 201 and the ink sheet 202 are conveyed, and then, in synchronism with the conveyance of the foregoing recording sheet 201 and ink sheet 202, the recording head 203*a* generates heat in accordance with the image signals to fuse (including sublimation, hereinafter the same) the coated ink on the ink sheet 202. It is thus arranged that the fused ink is transferred to the recording sheet 201 to form images. The recording sheet 201 on which the given images are formed by the above-mentioned recording means 203 is further conveyed. It is then arranged that the recorded sheet is being fed by the delivering rollers 205 to let it out from the apparatus through the outlet 207.

Now, the specific description will be made of the structures of the ink sheet 202 and ink reel 230 to be installed in the foregoing recording system. In FIG. 13, the ink leader member 210, or the guiding member, uses a film of 10 μm to 300 μm thick, which is wider than the width of the ink sheet 202 which is a strap medium. There are provided the stoppers 210*a* and 210*b* having the width which still wider. One side of the elongated ink sheet 202 is wound around the ink reel 230 which will be described later. The other side thereof is bonded to the ink leader member 210 by an adhesive tape, an adhesive bonding, or the like.

Also, the foregoing ink leader member 210 has the holes 210*c* which are provided for the automatic loading, and engage with the sprocket 203*c* which will be described later to convey the ink sheet 202. The positions of the holes 210*c* are in the direction substantially in parallel to the longitudinal direction of the ink sheet 202. The holes are provided continuously on both sides of the ink leader member 210 at a given pitch p. The width A between the opposing holes 210*c* is wider than the width C in the shorter direction of the ink sheet 202, and is narrower than the width B between the foregoing opposing stoppers 210*a* and 210*b*. This arrangement is required to avoid any interference of the recording head 203*a* and sprocket 203*c* which utilize the ink leader member 210 as a bias to the platen at the time of the automatic installation of the ink sheet 202, which will be described later.

In FIGS. 14A and 14B, a pivot 232 is formed on one end side in the longitudinal direction of the ink reel 230 which serves as the strap medium winding member, while on the other end side, a coupling part 233 is formed to engage with the reel 213 which will be described later. The foregoing coupling part 233 is configured almost like a hollow cylinder having the leading end 233*a* and coupling nails 233*b*.

For the ink reel 230, an ink sheet winding part 231 which is the first winding part is arranged. On both sides of this ink sheet winding part 231, the ink sheet leader winding parts 234*a* and 234*b* which are the second winding parts are formed, respectively. The outer diameters of the foregoing ink sheet leader winding parts 234*a* and 234*b* are larger than the outer diameter of the foregoing ink sheet winding part 231 when the ink sheet 202 is wound around it in a given quantity, thus avoiding any interference between the above-mentioned wound up ink sheet 202 and the ink leader members 210. Further, outside the foregoing ink leader winding parts 234*a* and 234*b*, the flange type ink leader stoppers 235*a* and 235*b* are formed. On the circumferences thereof, many numbers of the slits 236 are arranged to engagedly stop the stoppers 210*a* and 210*b* of the ink leader member 210.

In FIGS. 15A to 15C, the ink sheet 202 is wound around the foregoing ink sheet winding part 231 of the ink reel 230. The ink leader member 210 is wound around the foregoing ink leader winding parts 234*a* and 234*b*. At this juncture, the ink leader member 210 tends to become loose at all times due to its own resiliency, but the rear ends of the ink leader stoppers 210*a* and 210*b* are pinched by the extrusion 236*a* and slit wall 236*b* provided for the slit 236 of the ink leader stoppers 235*a* and 235*b* of the ink reel 230 so that it does not become loose by its own force. However, if the ink leader member 210 is long enough in the direction in which it is wound up and is wound around the foregoing ink leader winding parts 234*a* and 234*b* twice or three times, the ink leader member can be held on the slit only by its own resiliency. There is then no problem even if the extrusion 236*a* is not provided.

Subsequently, the description will be made of a case where the ink reel 230 is mounted in the recording apparatus, and then, the ink sheet is automatically installed. The reel 213 which fits in the foregoing ink reel 230 comprises a reel base 214 having a polygonal shaft 214*a* in its center and an abutting part on which the leading end of the coupling part 233 of the forgoing ink reel 230; a sliding member 215 having the nails 215*a* the inner configuration of which is polygonal corresponding to the shaft 214*a* and is slidable on the outer circumference of the shaft 214*a* in the longitudinal direction to engage with the coupling nails 233*b* of the coupling part 233; a spring 217 which gives a one-way bias to the sliding member 215; and a fixing member 216 mounted on the shaft 214*a* to engagedly hold the leading end of the sliding member 215 as shown in FIGS. 17A and 17B.

To the foregoing reel 213 a torque limiter (not shown) is connected to give it a constant load when rotating. It is thus arranged that a constant tension is given to the ink sheet 202 being drawn from the ink reel 230.

The sliding member 215 of the foregoing reel 213 is provided to make it easier to engage with the ink reel 230. When the sliding member 215 and the coupling nails 233*b* engage with each other, the sliding member 215 slides while rotating slightly in the rotating direction to disengage the contact between the nails 215*a* and coupling nails 238*b* for coupling even if these nails abut upon each other because there is a space between the inner diameter of the sliding member 215 and the outer diameter of the shaft 214*a* of the reel 213.

The mounting part of the recording apparatus for the ink reel 230 is arranged as shown in FIGS. 18A and 18B to allow the foregoing reel 213 to be rotatively mounted on the shaft 218 fixed to the rear chassis 219. The above-mentioned chassis 219 is mounted on the main chassis 220. On the main chassis 220, a front chassis 221 is mounted. On the front chassis 221, there is opened a hole 221*a* to which the ink reel 230 is inserted. Also, for the front chassis 221, a pressure board 224 capable of being opened and closed is provided. On this pressure board 224, there is a recess 240*c* which fits on the foregoing pivot 232, and between the pressure board 224 and this recess 240*c*, a spring member 225 is mounted.

Thus, when the pressure board 224 is closed after fitting the sliding member 215 of the reel 213 into the coupling part 233 of the ink reel 230, the abutting part 214*b* is caused by the bias of the spring member 225 to abut upon the leading end 233*a* of the coupling part 233. In this respect, it is arranged that the pivot 232 abut on the bottom of the recess 240c at that time. In this way, the reel is positioned in the longitudinal direction.

Figure 19A:
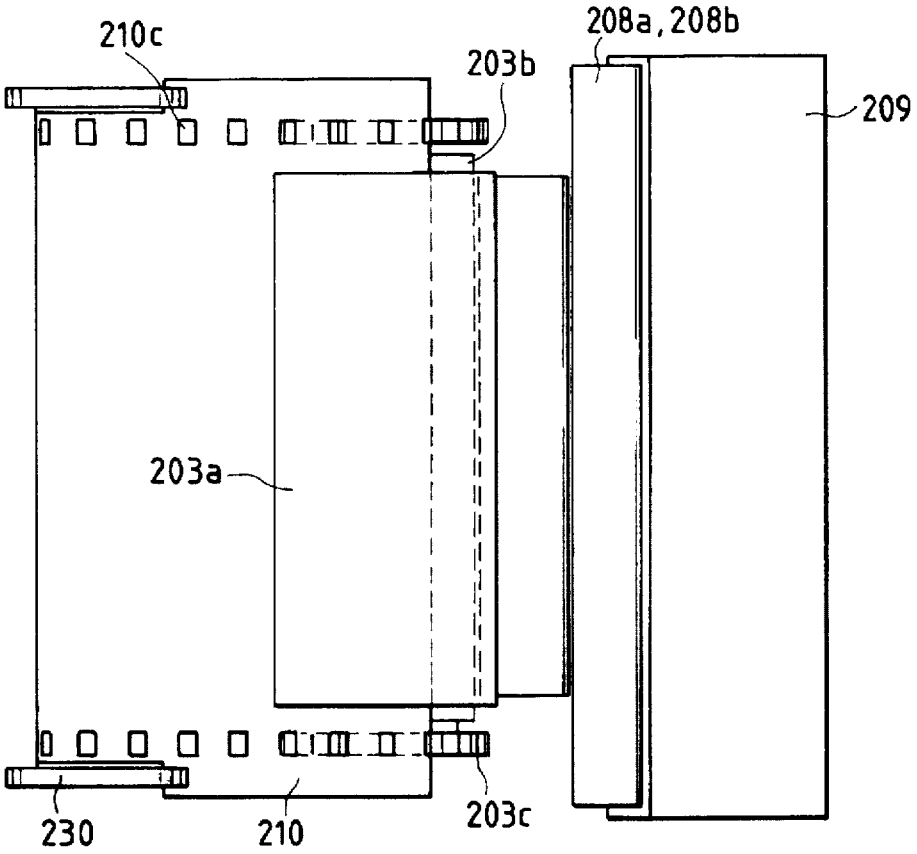
FIGS. 19A and 19B are cross-sectional views showing a state where an ink sheet is automatically fed by utilizing a guide member.
Figure 19B:
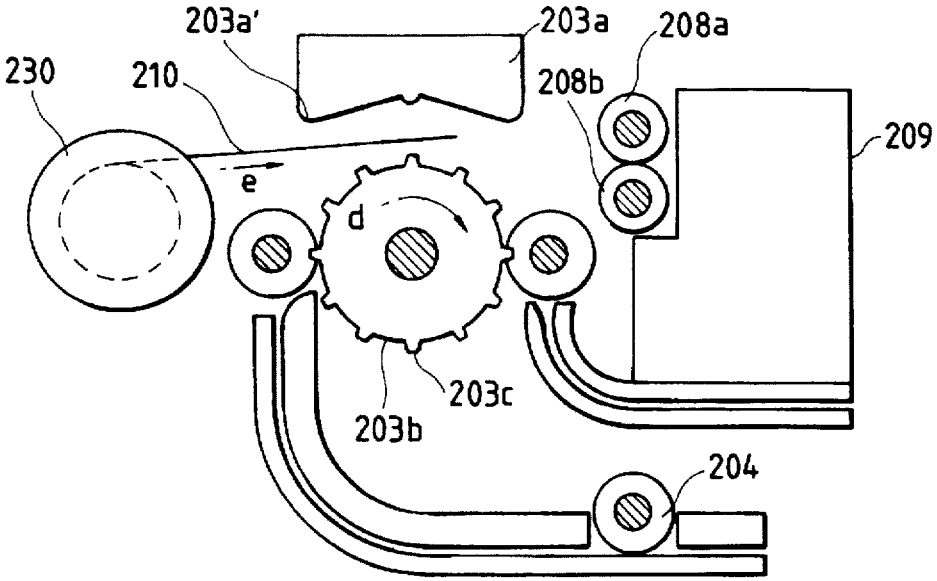
Figure 20A:
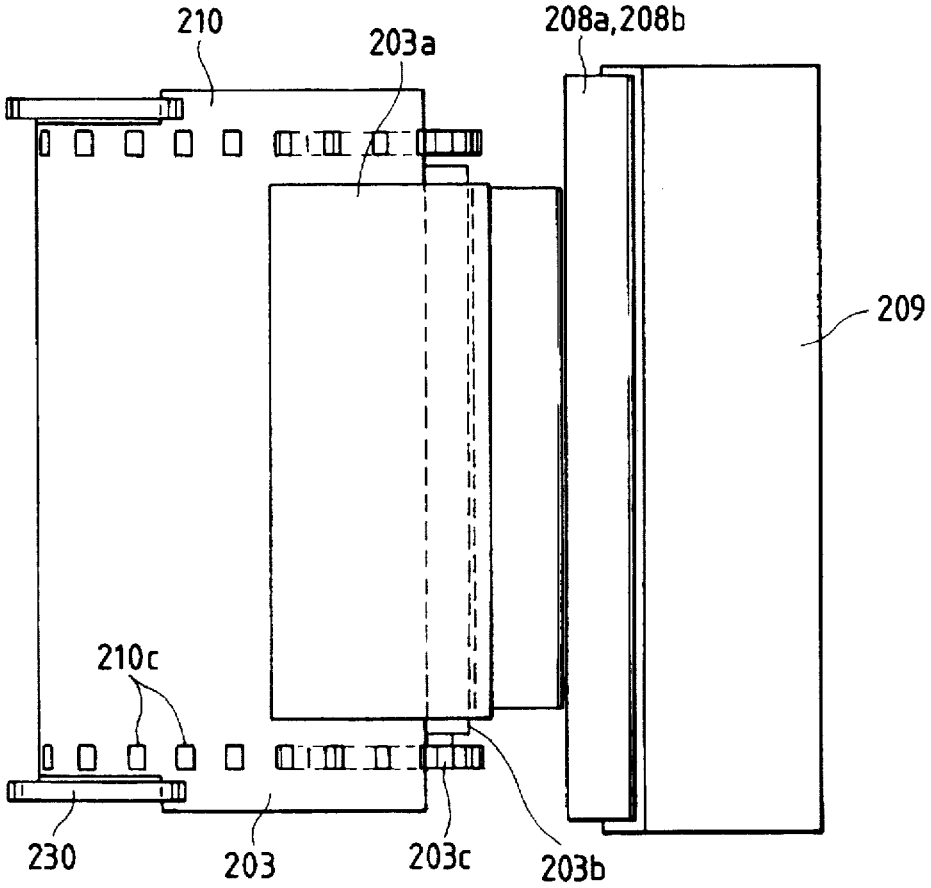
FIGS. 20A and 20B are cross-sectional views showing a state where an ink sheet is automatically fed by utilizing a guide member.
Figure 20B:
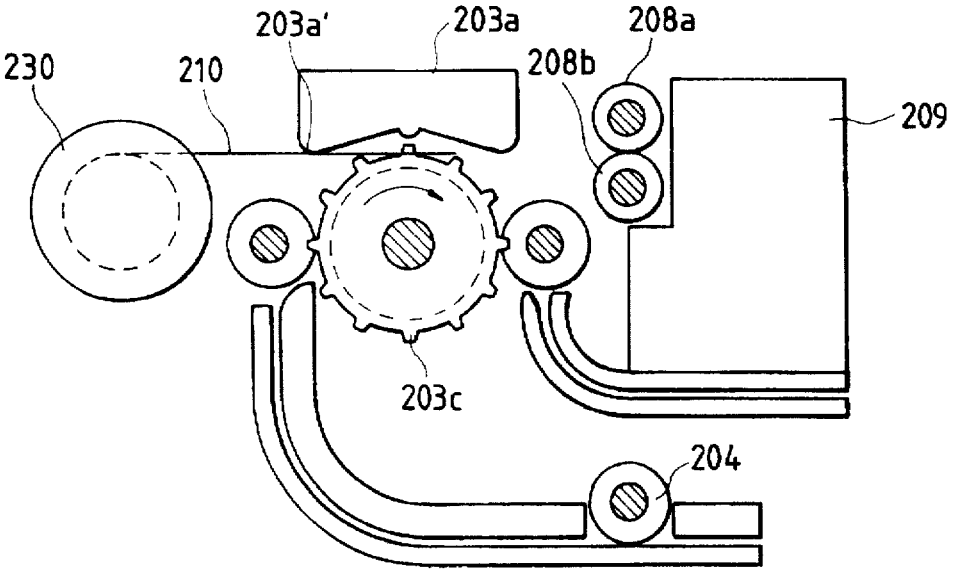

Now, with reference to FIGS. 19A to 23B, the description will be made of the automatic feeding operation of the ink sheet 202 using the ink leader member 210 according to the present embodiment. As shown in FIGS. 19A and 19B, when the ink reel 230 is installed in the recording apparatus, the ink leader member 210 is detected by a lead sensor (not shown) arranged above the sprocket 203c formed on the platen roller 203b. As shown in FIGS. 20A and 20B, the recording head 203a is lowered by means of a driving device which is not shown, and then, stopped at a given interval to the platen roller 203b. This movement results from the event that the abutting part 203a' of the recording head 203a abuts upon the ink leader part 210 to bias the ink leader member 210 to the sprocket 203c side.

Then the platen roller 203b is driven to cause the sprocket 203c to rotate in the direction indicated by an arrow d. The holes 210c provided for the ink leader member 210 engage with the teeth of the sprocket 203c to convey the ink leader member 210 in the direction indicated by an arrow e.

Figure 21A:
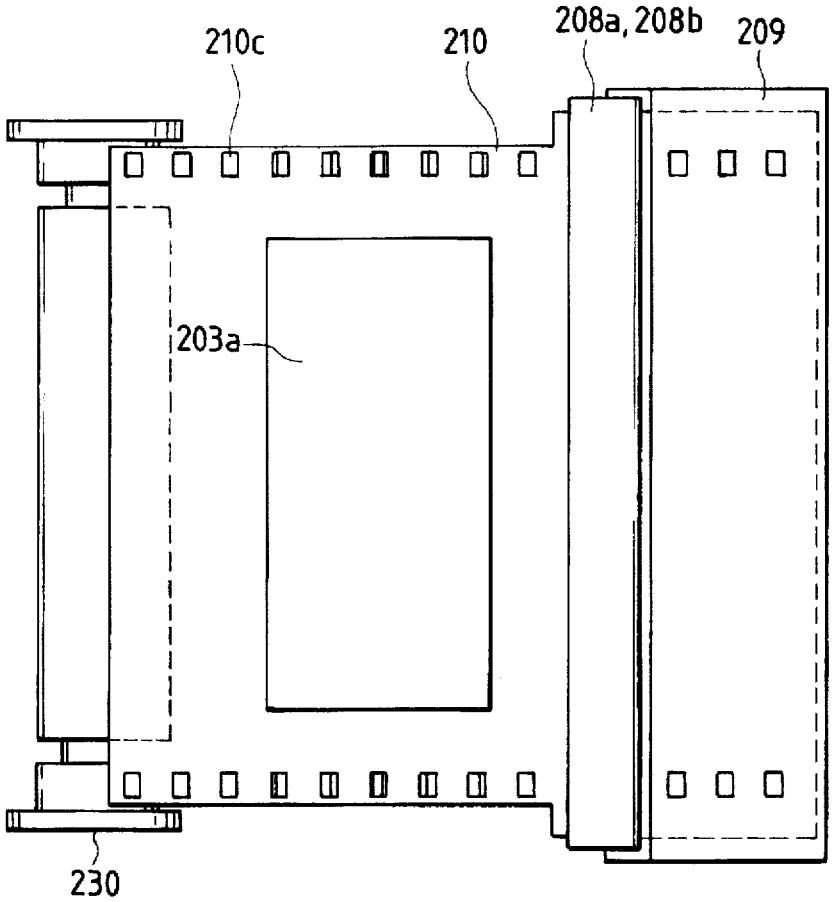
FIGS. 21A and 21B are cross-sectional views showing a state where an ink sheet is automatically fed by utilizing a guide member.
Figure 21B:
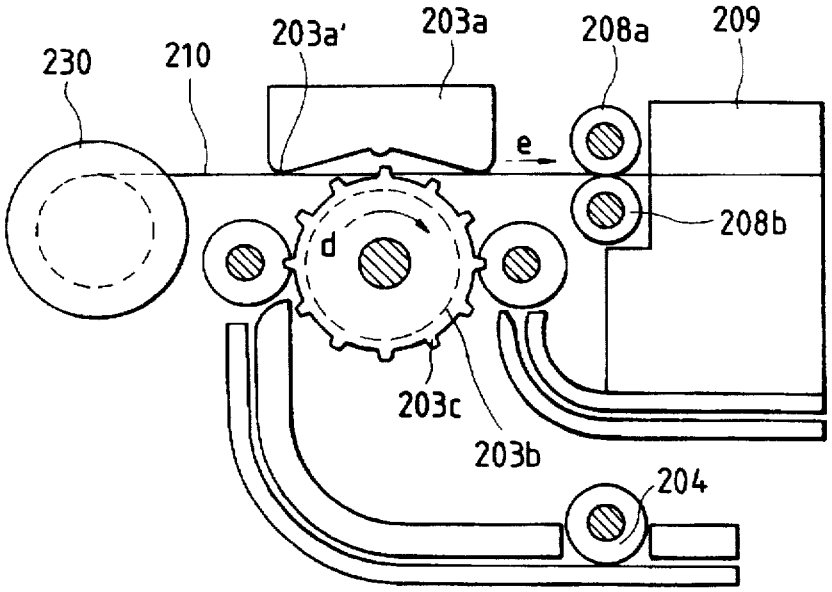

Subsequently, as shown in FIGS. 21A and 21B, the ink leader member 210 thus conveyed is nipped by a pair of feeding rollers 208a and 208b. These feeding rollers 208a and 208b are coupled with the platen roller 203b by the gear train which is not shown. The circumferential speed of the foregoing feeding rollers 208a and 208b is equal to or slightly faster than that of the platen roller 203b.

Figure 22A:
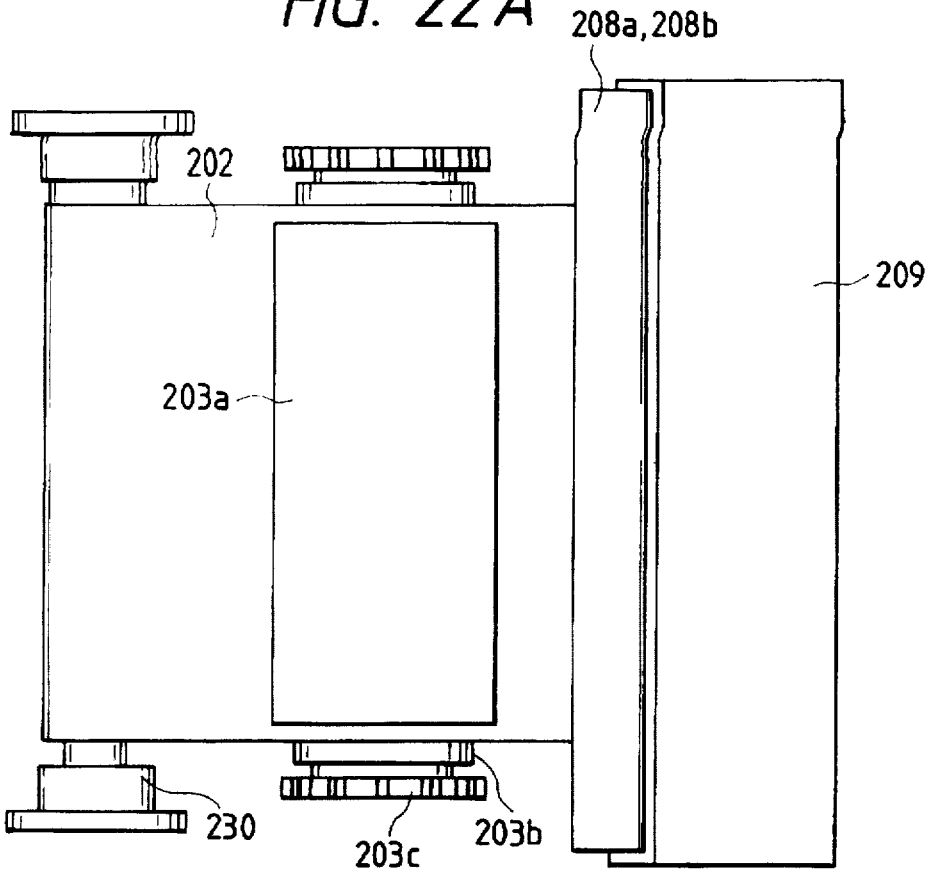
FIGS. 22A and 22B are cross-sectional views showing a state where an ink sheet is automatically fed by utilizing a guide member.
Figure 22B:
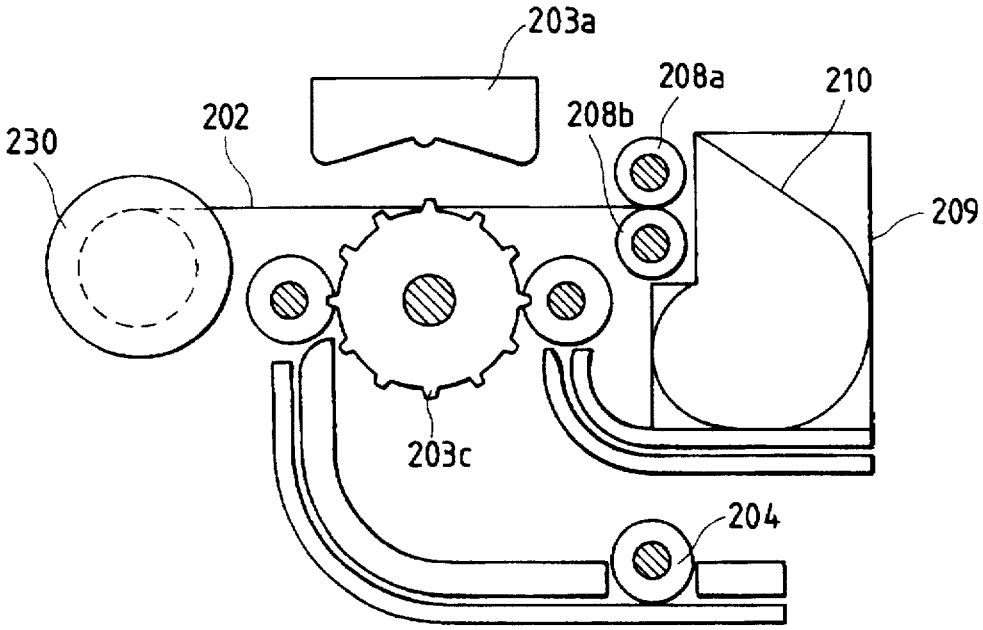

Also, as shown in FIGS. 22A and 22B, the rotation of the feeding rollers 208a and 208b is suspended when an ink sheet head mark of the ink sheet 202 being drawn by the feeding rollers 208a and 208b from the ink reel 230 is detected by a sensor (not shown) which is mounted in the vicinity of the recording head 203a. The recording head 203a is returned to its initial position by a driving device which is not shown. With the operation described above, the automatic installation of the ink sheet 202 is completed, thus making the recording ready.

Then, when the printing is started, the ink sheet is being fed during the printing by the force exerted by the rotation of the platen roller 203b when the recording head 203a is depressed to the recording sheet 201. The recorded ink sheet 202 is conveyed by the feeding rollers 208a and 208b to an ink sheet retainer 209, or a collecting member, arranged in the downstream of the feeding rollers 208a and 208b. This ink sheet retainer 209 is equipped as an individual packaging case for the ink reel 230, and the operator installs it in the apparatus main body for use together with the above-mentioned ink reel 230 for collecting the used ink sheet 202 which is being fed from the ink reel 230.

Figure 23A:
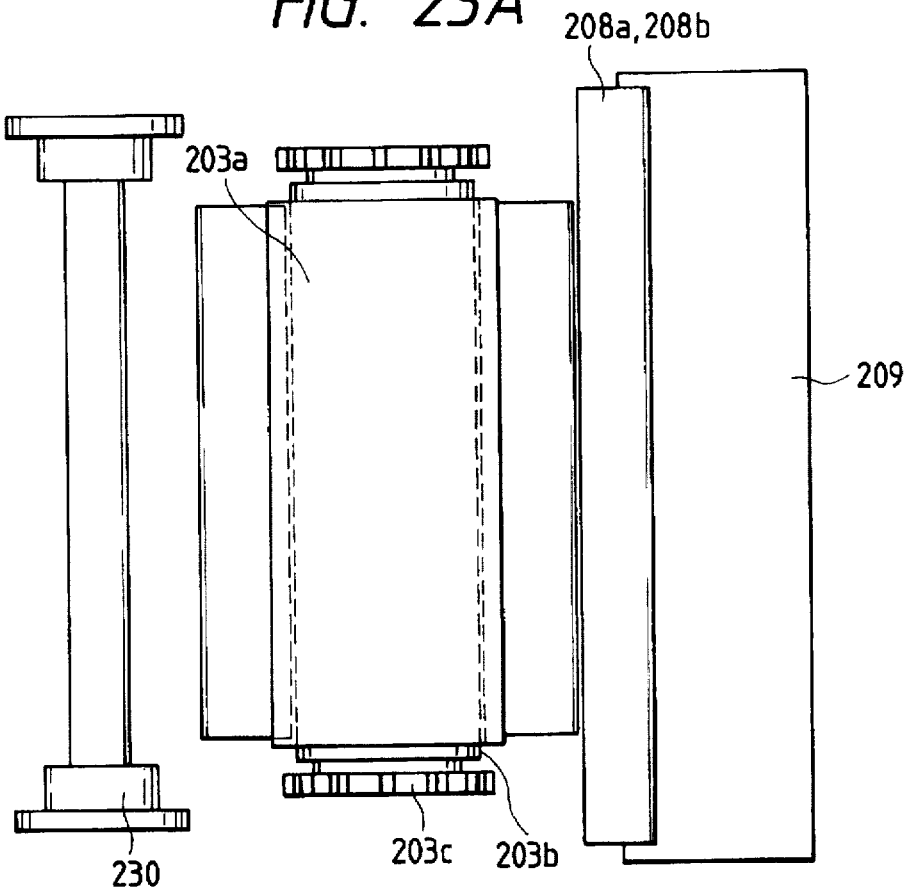
FIGS. 23A and 23B are cross-sectional views showing a state where an ink sheet is automatically fed by utilizing a guide member.
Figure 23B:
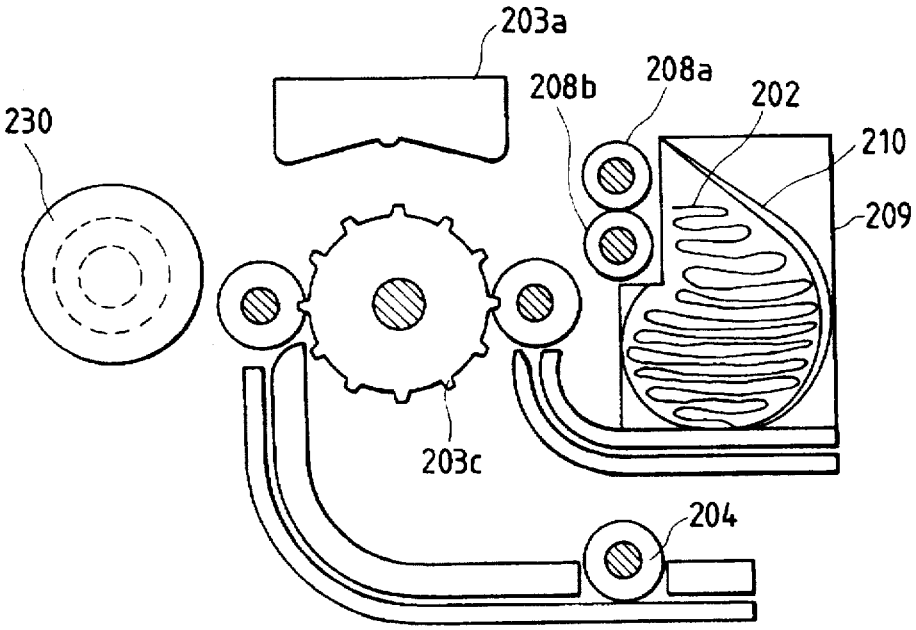

As shown in FIGS. 23A and 23B, the ink sheet 202 which has been used to the very last is separated from the ink reel 230. All the used ink sheets are ultimately stored in the ink sheet retainer 209. Therefore, the operator simply removes the used ink sheets 202 together with the ink sheet retainer 209 and discard them as non-flammable matter. It is extremely easy to handle them. Also, the empty ink reel 230 which is a molded product can be collected for reuse in an appropriate route, making it possible to implement the resource saving.

(Fourth Embodiment)

Figure 24:
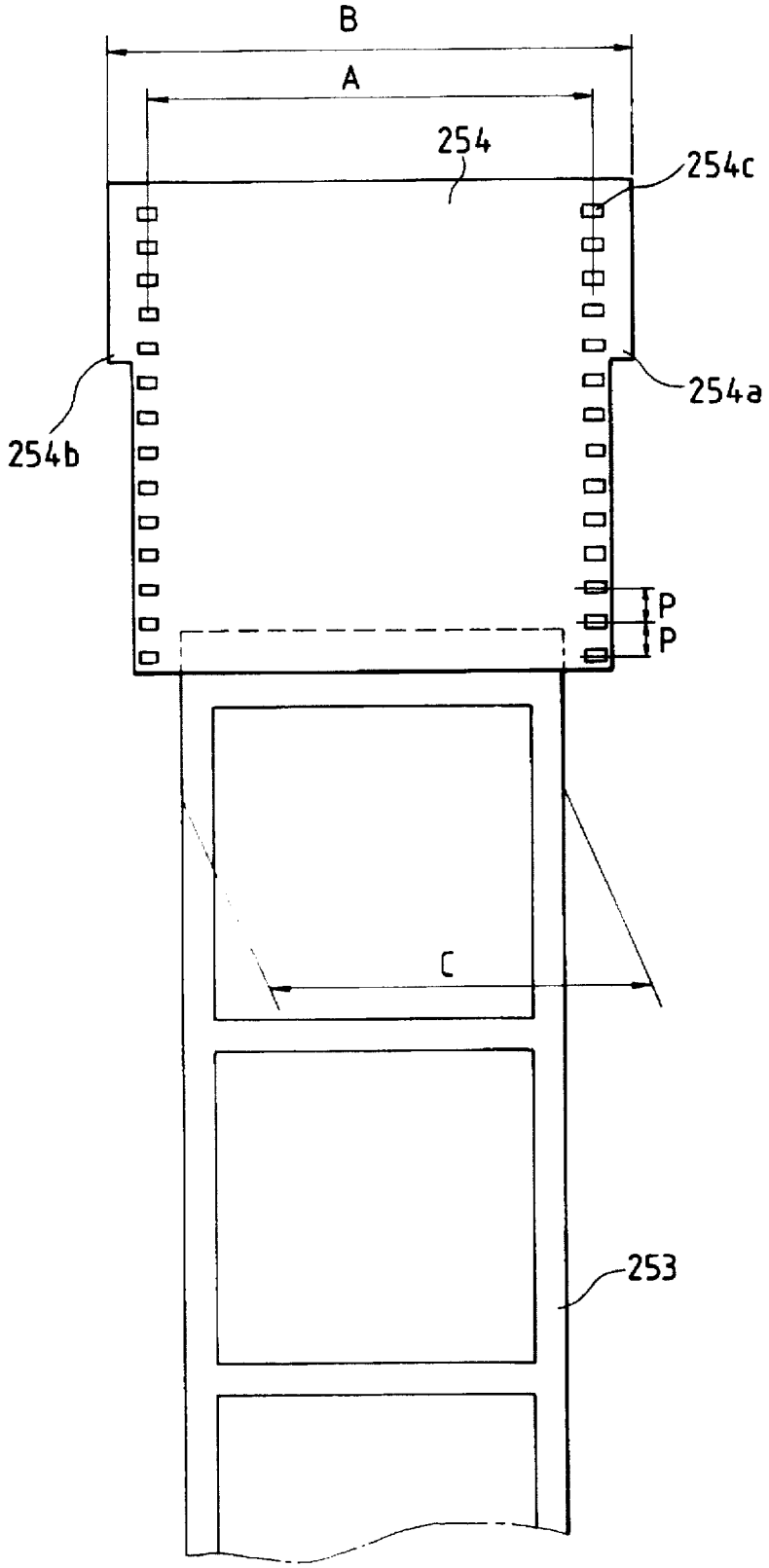
FIG. 24 is a view illustrating an ink sheet and an ink sheet leader serving as a guiding member according to still another embodiment.
Figure 25:
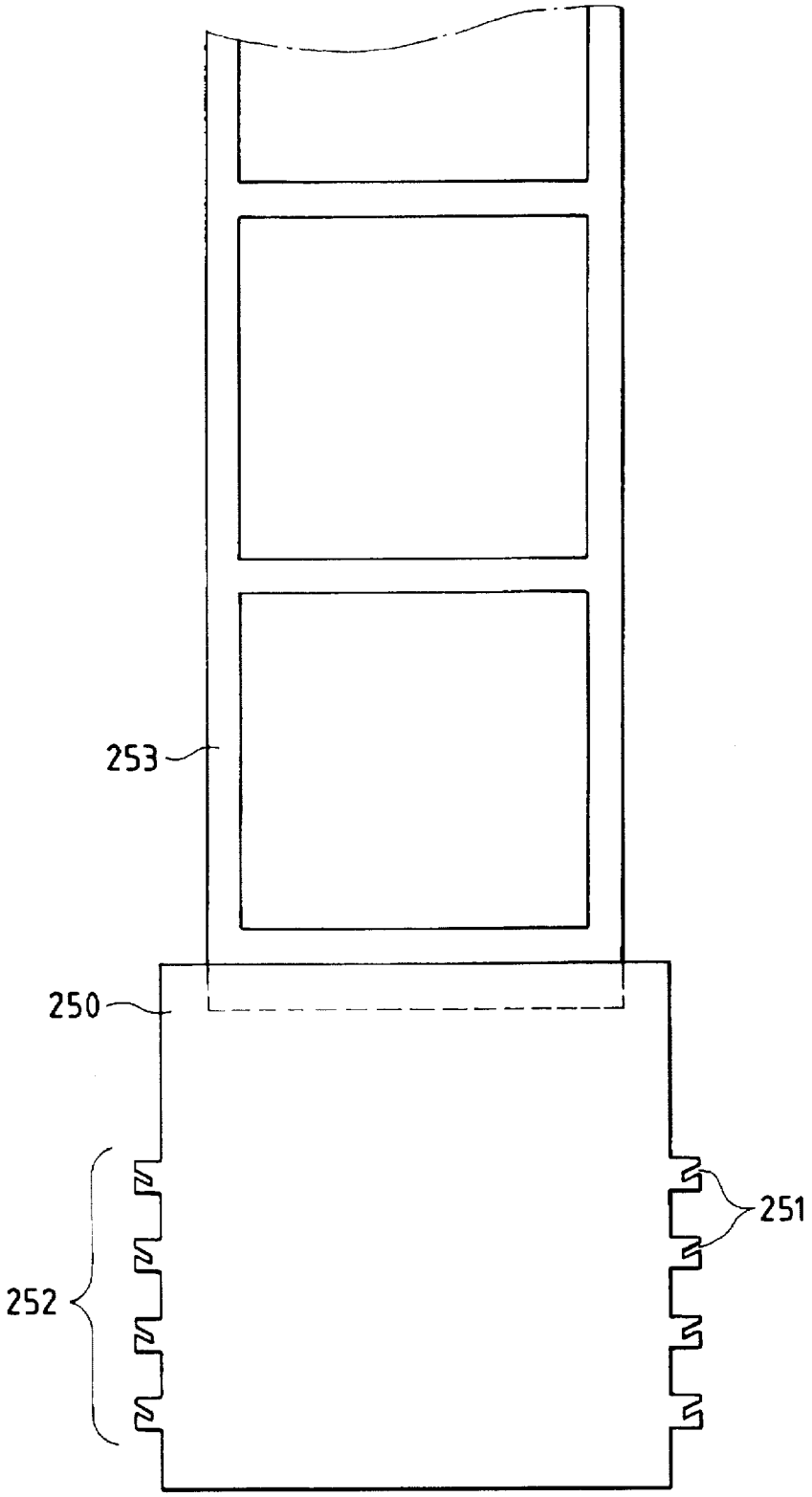
FIG. 25 is a view illustrating an ink sheet and a reel sheet serving as a winding member.
Figure 26A:
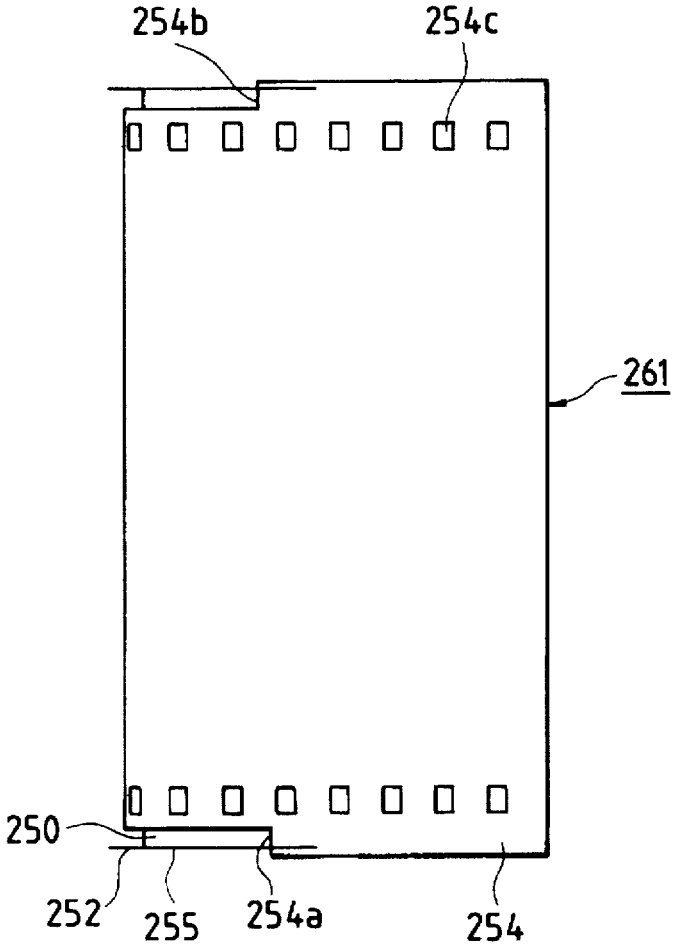
FIGS. 26A and 26B are views illustrating a state where an ink sheet and ink sheet leader are wound around the reel sheet which has been wound up in a cylindrical form.
Figure 26B:
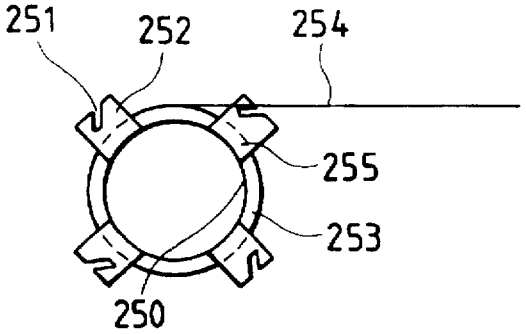

FIG. 24 is a view illustrating an ink sheet serving as a strap medium, and an ink sheet leader part as a first guiding member. FIG. 25 is a view illustrating an ink sheet serving as a strap medium and a reel sheet as a second guiding member. FIGS. 26A and 26B are views illustrating the state where the ink sheet and ink leader member are wound around the reel sheet which has been wound up cylindrically.

At first, the specific description will be made of the structure of an ink sheet which will be installed in the foregoing recording system. In FIG. 24, an ink leader member 254 is bonded by an adhesive tape or the like (not shown) to the one end of an elongated ink sheet 253. For the foregoing ink leader member 254, a polyethylene terephthalate, polyvinyl chloride, or the like having a thickness of 10 μm to 300 μm without containing any plasticizer is used. Its width is wider than that of the ink sheet. The stoppers 254a and 254b which are wider still are provided.

Also, on the foregoing ink leader member 254, the holes 254c are arranged for the automatic installation, which engage with the above-mentioned sprocket 203c to feed the ink sheet 253. The positions of the holes 254c are substantially in parallel with the longitudinal direction of the ink sheet 253, and the holes are continuously provided on both sides of the ink leader member 254 at a given pitch p. The opposing width A of the holes 254c is wider than the width C of the ink sheet 253 in the shorter direction, but is narrower than the opposing width B of the foregoing stoppers 254a and 254b. This is arranged in order to avoid any interference of the recording head 203a and sprocket 203c which utilize the ink leader member 254 for biasing the platen when the ink sheet 253 is automatically installed as described above.

In FIG. 25, the lead sheet 250 which serves as a second guiding member is bonded by an adhesive tape or the like is bonded to the other end of the foregoing ink sheet 253. For this reel sheet 250, a polyethylene terephthalate, polyvinyl chloride, or the like having a thickness of 10 μm to 300 μm without containing any plasticizer is used. Its width is wider than that of the ink sheet 253, and the teeth 252 having slits 251 on a part thereof are formed. In this respect, FIG. 25 represents a state that the teeth 252 are developed with respect to the reel sheet 250.

In FIGS. 26A and 26B, the ink reel 261 winds up the reel sheet 250 around it to form a cylindrical reel sheet 250. The teeth 252 having the slits 251 is folded to rise. The ink sheet 253 is wound around the reel sheet 250, and the ink leader member 254 is also wound around the ink sheet 253 which has been wound up. The trailing ends of the ink leader stopper 254a and 254b are pinched and held by the slit 251 of the foregoing teeth 252.

Figure 27A:
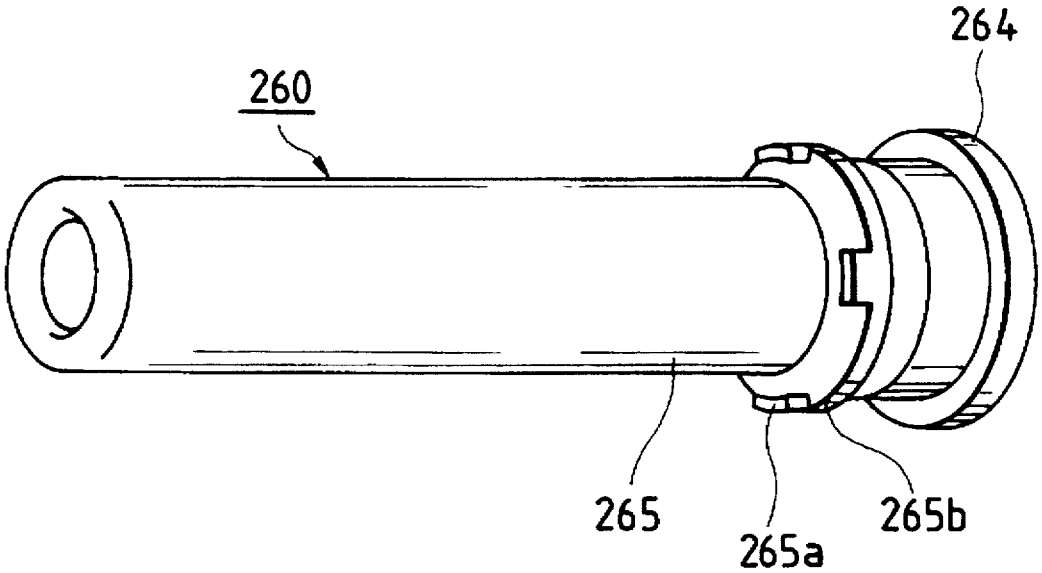
FIGS. 27A and 27B are a perspective view and a cross-sectional view showing a reel base which fits into an ink reel.
Figure 27B:
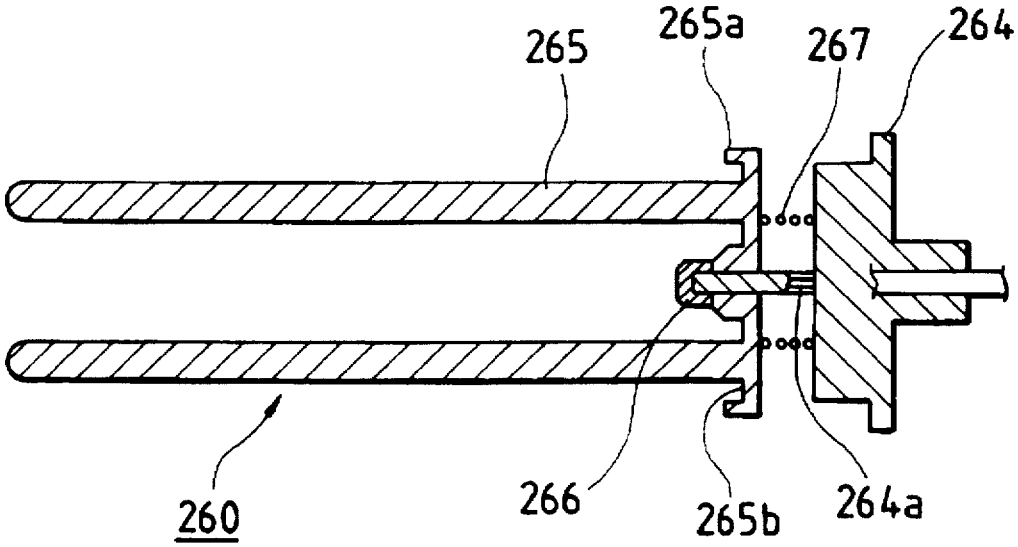

Subsequently, the description will be made of a case where the ink reel 261 is mounted in the recording apparatus, and the ink sheet is automatically installed. As shown in FIGS. 27A and 27B, the reel 260 fitted into the foregoing cylindrical reel sheet 250 comprises a sliding member 265 having a polygonal shaft 264a which fits in the center of the reel base 264, the nails 265a the inner configuration of which is polygonal corresponding to the shaft 264a and slidable on the outer circumference of the shaft 264a in the longitudinal direction to engage with the teeth 252 in the circumferential direction, a sliding member 265 having a flange 265b which abuts upon the abutting part 255 of the foregoing reel sheet 250, a spring 267 which gives a one-way bias to the foregoing sliding member 265, and a fixing member 266 mounted on the foregoing shaft 264a to stop the end of the foregoing sliding member 265.

To the foregoing reel 260, a torque limiter (not shown) is connected to give a constant load thereto when rotating. It is thus arranged that a constant tension is given to the ink sheet 253 being drawn from the cylindrical reel sheet 250. Also, the sliding member 265 of the foregoing reel 260 is provided to make it easier to engage with the teeth 252 of the cylindrical reel sheet 250. When the sliding member 265 and the teeth 252 engage with each other, the sliding member 265 slides while rotating slightly in the rotating direction to disengage the contact between the nails 265*a* and teeth 252 for coupling even if these nails and teeth abut upon each other because there is a space between the inner diameter of the sliding member 265 and the: outer diameter of the shaft 264*a* of the reel base 264.

Figure 28A:
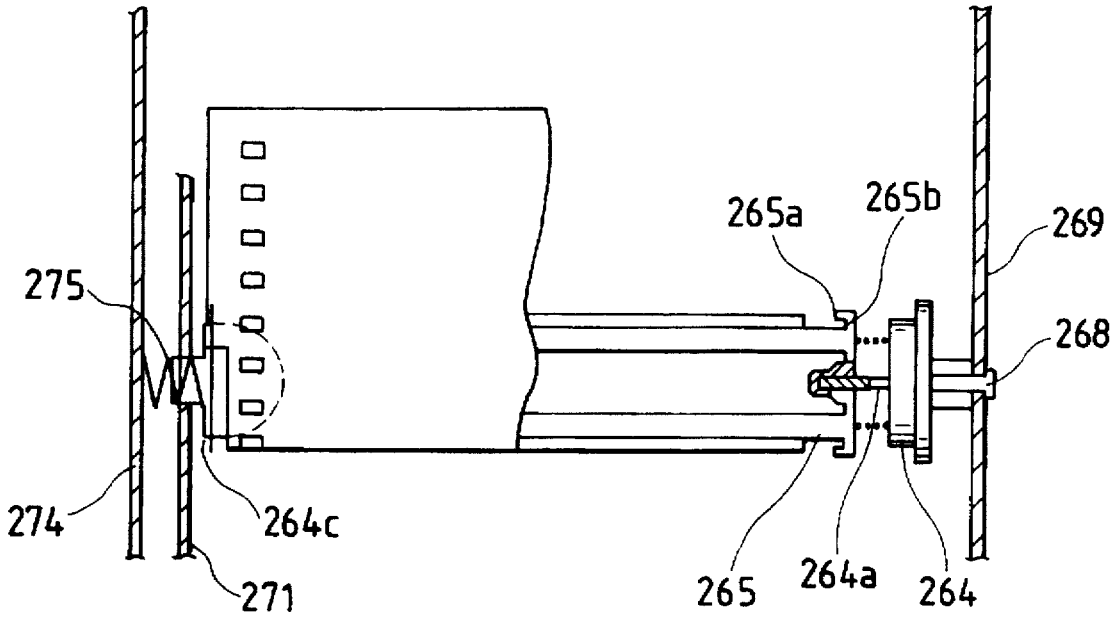
FIGS. 28A and 28B are cross-sectional views showing a state where an ink reel having a guide member wound around it is installed in the main body.
Figure 28B:
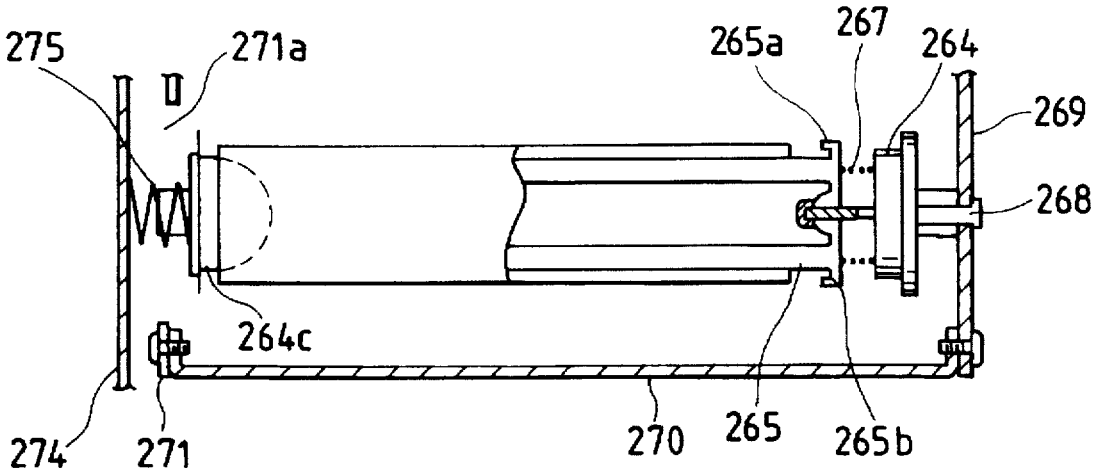
Figure 29:
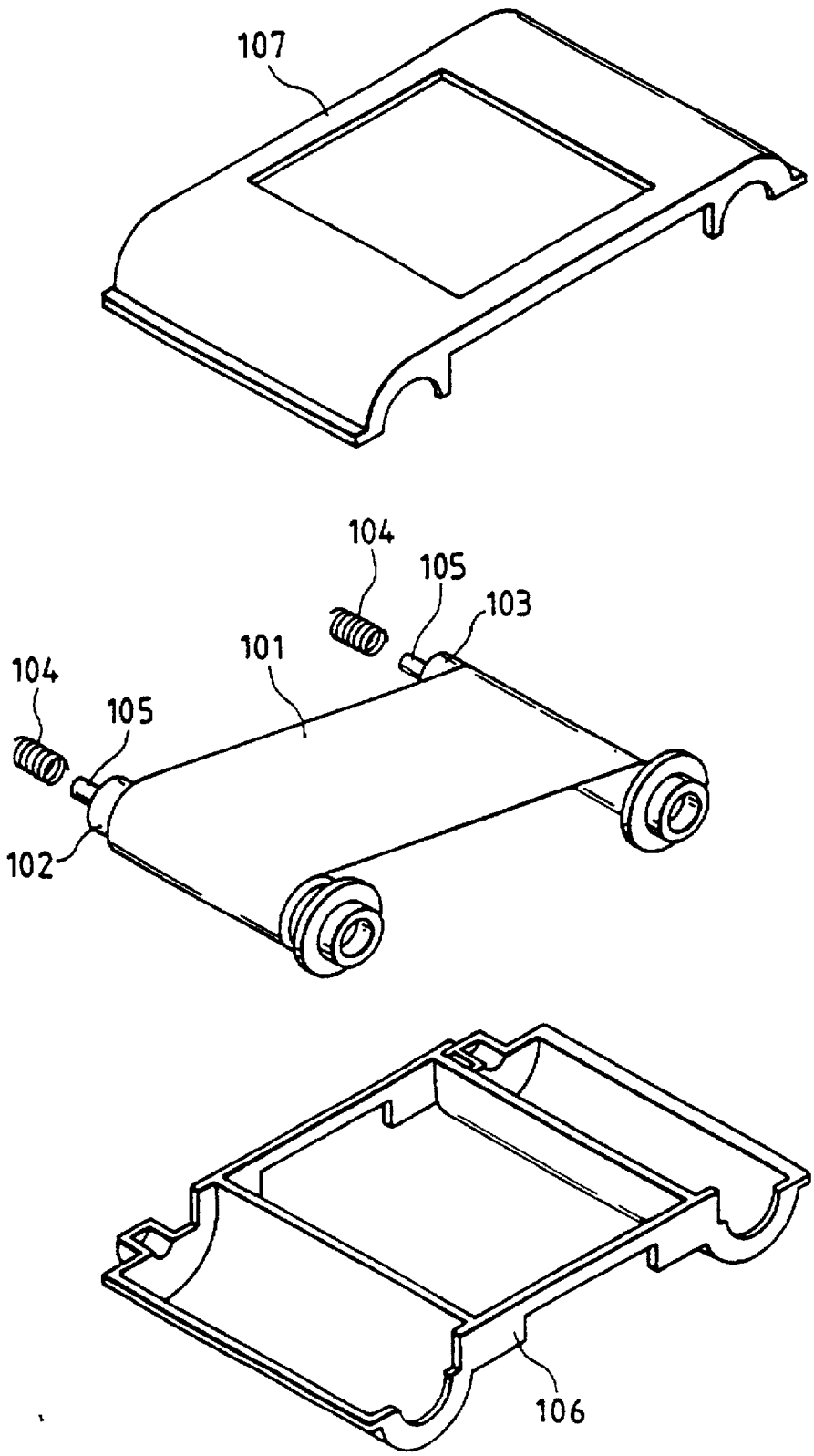
FIG. 29 PRIOR ART
FIG. 29 is a view illustrating a conventional ink sheet cassette.
Figure 30A:
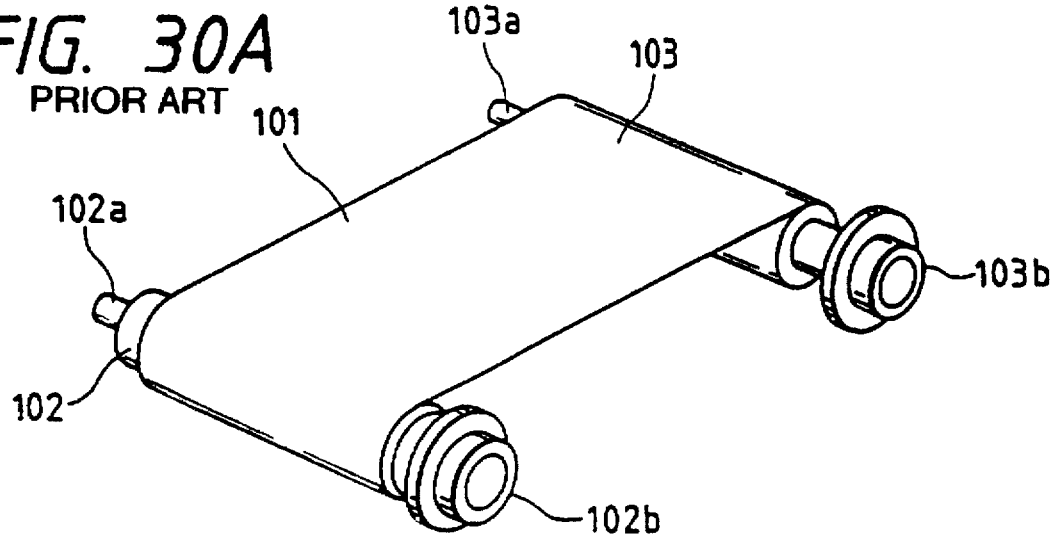
FIG. 30A PRIOR ART
FIGS. 30A and 30B are views illustrating a conventional ink sheet cassette of an ink sheet replaceable type.
Figure 30B:
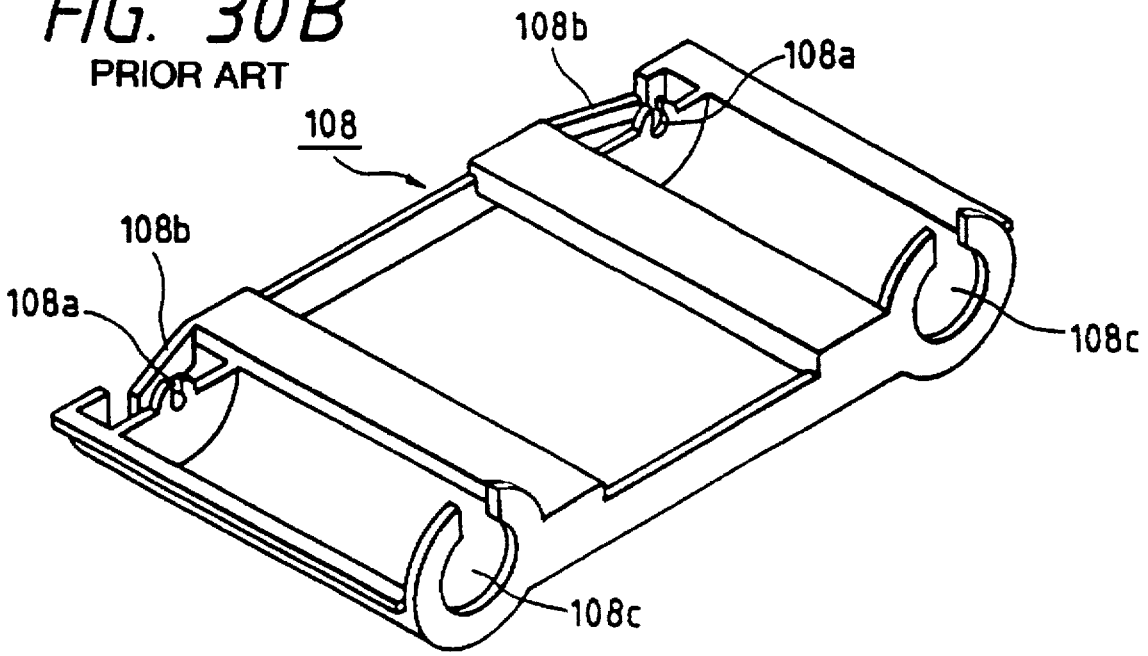
FIG. 30B PRIOR ART
Figure 31A:
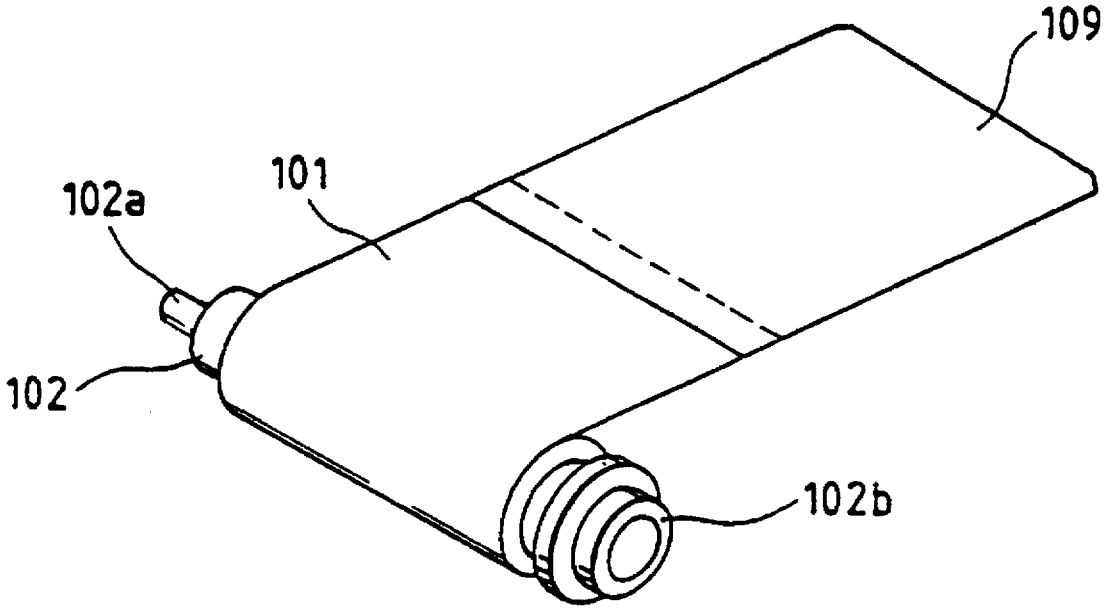
FIG. 31A PRIOR ART
FIGS. 31A and 31B are views illustrating an ink sheet to which a conventional lead film is bonded.
Figure 31B:
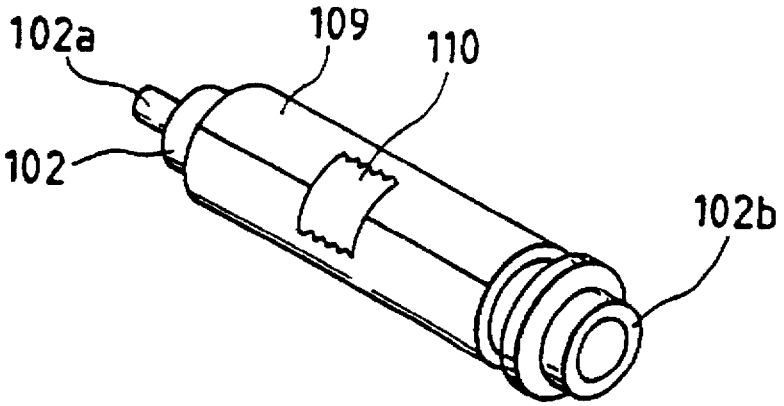
FIG. 31B PRIOR ART

The mounting part of the recording apparatus for the ink reel 261 is arranged as shown in FIGS. 28A and 28B to allow the foregoing reel 260 to be rotatively mounted on the shaft 268 fixed to the rear chassis 269. The above-mentioned chassis 269 is mounted on the main chassis 270. On the main chassis 270, a front chassis 271 is mounted. On the front chassis 271, there is opened a hole 271*a* to which the cylindrical reel sheet 250 is inserted.

Then, for the front chassis 271, a pressure board 274 capable of being opened and closed is provided. On this pressure board 274, there is provided an extrusion 274*c* which fits in the inner circumference of the foregoing cylindrical reel sheet, and between the pressure board 274 and this extrusion, a spring member 275 is mounted.

Thus, when the pressure board 274 is closed after fitting the sliding member 265 of the reel 260 into the inner circumference of the cylindrical reel sheet 250, the flange 265*b* is caused by the bias of the spring member 275 to contact the abutting part 255 of the cylindrical reel sheet 250.

With the method described above, the ink sheet 253 is automatically fed, and the ink sheet which has been used up to the very end becomes a strap because the cylindrical reel sheet 250 is ultimately unfastened. All of them are stored in the ink sheet retainer 209 after all. The operator can simply take out the used ink sheet 253 together with the ink sheet retainer 209 and discard them as nonflammable matter. Therefore, it is easier for the operator to handle the ink sheet. Also, no empty reels remain to make the further promotion of the resource saving possible.

According to the above-mentioned third and fourth embodiments, the strap medium is wound around the first winding part which is a strap medium winding up member, and the guiding member bonded to its free end is wound around the second winding member. Thus, by engagedly holding the end of the foregoing guiding member in the slit of the flange type stoppers, it is possible to maintain the recording medium in a mountable state. As a result, the tape and others which have hitherto been required to hold the guiding member can be omitted. Accordingly, it becomes possible to prevent the strap medium from being unfastened even if a shock is exerted by falling down or the like.

Also, it is possible to automatically install the recording medium by drawing the foregoing strap medium in the longitudinal direction after mounting the strap medium winding member with the foregoing strap medium wound around it in the apparatus main body.

Also, the used strap medium, and the strap medium winding member which is a molded product can be discriminated easily without any trouble on the part of the operator. At the same time, since the molded product can be collected for reuse, it is possible to contributing to the resource saving.

What is claimed is:

1. A recording apparatus for forming an ink image on a recording sheet using ink contained in an ink sheet, said recording apparatus comprising:

a platen for supporting and conveying a recording sheet at a recording area where recording is performed;

a recording section for pressing and heating the ink sheet onto the recording sheet at the recording area to form an ink image on the recording sheet;

an ink sheet cassette accommodating the ink sheet; and an ink sheet cassette mounting section for mounting said ink sheet cassette having a first accommodating section for rotatably accommodating an ink sheet that is wound therein; a second accommodating section for winding and accommodating the ink sheet taken out from the first accommodating section, a first winding member provided adjacent one side of the second accommodating section in a widthwise direction of the ink sheet, the first winding member having a first peripheral surface that contacts the ink sheet only at a widthwise edge portion of the ink sheet; a second winding member provided adjacent another side of the second accommodating section opposite the one side in the widthwise direction of the ink sheet, the second winding member having a second peripheral surface that contacts the ink sheet only at a widthwise edge portion of the ink sheet opposite, in the widthwise direction of the ink sheet, the widthwise edge portion contacted by the first winding member, each of the first peripheral surface and the second peripheral surface of the first winding member and the second winding member being provided with a plurality of projections to be engaged with a plurality of holes disposed along the widthwise edge portions of the ink sheet.

2. A recording apparatus according to claim 1, wherein a conveying member for conveying the ink sheet is provided in a conveyance route between the first accommodating section and the second accommodating section.

3. A recording apparatus according to claim 2, wherein the conveying member is a rotatable member having a plurality of projections to be engaged with a plurality of holes disposed along the widthwise edge portion of the ink sheet.

4. A recording apparatus according to claim 1, wherein a third winding member is provided on a side of the first accommodating section in the widthwise direction of the ink sheet and the third winding member has a periphery which is in contact with only a widthwise edge portion of trailing end of the ink sheet and unwinds the ink sheet.

5. A recording apparatus according to claim 4, wherein the periphery of the third winding member is provided with a plurality of projections to be engaged with a plurality of holes disposed along the widthwise edge portion of the ink sheet.

6. An ink sheet cassette for accommodating an ink sheet containing ink for forming an ink image on a recording sheet, said ink sheet cassette comprising:

a first accommodating section for rotatably accommodating an ink sheet that is wound therein;

a second accommodating section for winding and accommodating the ink sheet taken out from said first accommodating section;

a first winding member provided adjacent one side of said second accommodating section in a widthwise direction of the ink sheet, said first winding member having a first peripheral surface that contacts the ink sheet only at a widthwise edge portion of the ink sheet;

a second winding member provided adjacent another side of said second accommodating section opposite said one side in the widthwise direction of the ink sheet, said second winding member having a second peripheral surface that contacts the ink sheet only at a widthwise edge portion of the ink sheet opposite, in the widthwise direction of the ink sheet, the widthwise edge portion contacted by said first winding member, each of said first peripheral surface and said second peripheral surface being provided with a plurality of projections to be engaged with a plurality of holes disposed along the widthwise edge portions of the ink sheet; and drive means for synchronously driving said first winding member and said second winding member to wind the ink sheet, wherein said first winding member and said second winding member cooperatively wind the ink sheet without the ink sheet being supported in the widthwise direction other than the edge portions.

7. An ink sheet cassette according to claim 6, wherein a conveying member for conveying the ink sheet is provided in a conveyance route between said first accommodating section and said second accommodating section.

8. An ink sheet cassette according to claim 7, wherein the conveying member is a rotatable member having a plurality of projections to be engaged with a plurality of holes disposed along the widthwise edge portion of the ink sheet.

9. An ink sheet cassette according to claim 6, wherein a third winding member is provided on a side of said first accommodating section in the widthwise direction of the ink sheet and the third winding member has a periphery which is in contact with only a widthwise edge portion of a trailing end of the ink sheet and unwinds the ink sheet.

10. An ink sheet cassette according to claim 9, wherein the periphery of the third winding member is provided with a plurality of projections to be engaged with a plurality of holes disposed along the widthwise edge portion of the ink sheet.

11. A method for winding an ink sheet accommodated in an ink sheet cassette and containing ink for forming an ink image on a recorded sheet, the method comprising the steps of:

rotatably accommodating an ink sheet wound on a first accommodating section in the ink sheet cassette;

providing a second accommodating section in the ink sheet cassette for winding the ink sheet taken out from the first accommodating section;

providing first and second winding members on opposite sides of the second accommodating section in a widthwise direction of the ink sheet, a first peripheral surface of the first winding member contacting only one widthwise edge portion of the ink sheet and a second peripheral surface of the second winding member contacting only a widthwise edge portion of the ink sheet opposite, in a widthwise direction of the ink sheet, the widthwise edge portion contacted by the first winding member, each of the first peripheral surface and the second peripheral surface being provided with a plurality of projections to be engaged with a plurality of holes disposed along the widthwise edge portions of the ink sheet;

driving in synchronism the first and second winding members to wind the ink sheet from the first accommodating section to the second accommodating section cooperatively without the ink sheet being supported in a widthwise direction other than at the edge portions.

* * * * *

UNITED STATES PATENT AND TRADEMARK OFFICE

CERTIFICATE OF CORRECTION

PATENT NO. : 5,727,883

DATED : March 17, 1998

INVENTOR(S) : Kusano et al.

It is certified that error appears in the above-identified patent and that said Letters Patent is hereby corrected as shown below:

[57] ABSTRACT:

Line 5, "images" should read --images on--; and
Line 9, "member" should read --members--.

COLUMN 3:

Line 17, "a" should be deleted; and
Line 52, "a" should be deleted and "Guiding" should read --guiding--.

COLUMN 6:

Line 45, "holder The" should read --holder 33. The--.

COLUMN 10:

Line 12, "the." should read --the--.

COLUMN 11:

Line 21, "an" should read --by an--.

COLUMN 12:

Line 66, "the-" should read --the--.

UNITED STATES PATENT AND TRADEMARK OFFICE

CERTIFICATE OF CORRECTION

PATENT NO. : 5,727,883

DATED : March 17, 1998

INVENTOR(S) : Kusano et al.

It is certified that error appears in the above-identified patent and that said Letters Patent is hereby corrected as shown below:

COLUMN 14:

Line 58, "it is installed." should read --it.--.

COLUMN 15:

Line 26, "which" should read --which is--.

COLUMN 19:

Line 9, "the:" should read --the--; and
Line 62, "contributing" should read --contribute--.

COLUMN 20:

Line 43, "of" should read --of a--.

COLUMN 22:

Line 24, "sheet;" should read --sheet; and--.

Signed and Sealed this

Tenth Day of November 1998

Bruce Lehman

*Attest:*

BRUCE LEHMAN

*Attesting Officer*

*Commissioner of Patents and Trademarks*